US012751592B2

(12) United States Patent
Cho et al.

(10) Patent No.: US 12,751,592 B2
(45) Date of Patent: Oct. 6, 2026

(54) VACUUM CLEANER SYSTEM NOTIFYING STATE OF DUST COLLECTION PART AND OPERATING METHOD OF VACUUM CLEANER SYSTEM

(71) Applicant: Samsung Electronics Co., Ltd., Suwon-si (KR)

(72) Inventors: Jeonghee Cho, Suwon-si (KR); Sanghyuk Park, Suwon-si (KR); Seongu Lee, Suwon-si (KR); Jihye Seo, Suwon-si (KR); Kiyong Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 116 days.

(21) Appl. No.: 18/541,704

(22) Filed: Dec. 15, 2023

(65) Prior Publication Data

US 2024/0206691 A1 Jun. 27, 2024

Related U.S. Application Data

(63) Continuation of application No. PCT/KR2023/020447, filed on Dec. 12, 2023.

(30) Foreign Application Priority Data

Dec. 21, 2022 (KR) ..... 10-2022-0180889

(51) Int. Cl.
*A47L 9/28* (2006.01)
*A47L 9/00* (2006.01)

(52) U.S. Cl.
CPC ..... *A47L 9/2842* (2013.01); *A47L 9/0063* (2013.01); *A47L 9/2821* (2013.01); *A47L 9/2873* (2013.01); *A47L 2201/06* (2013.01)

(58) Field of Classification Search
None
See application file for complete search history.

(56) References Cited

U.S. PATENT DOCUMENTS 11,006,806 B2 5/2021 Cargill et al.
11,357,372 B2 6/2022 Buening et al.
(Continued)

FOREIGN PATENT DOCUMENTS

DE 10 2019 004 417 A1 12/2020
DE 10 2019 114 344 B4 5/2021
(Continued)

OTHER PUBLICATIONS

International Search Report dated Mar. 8, 2024, issued in International Patent Application No. PCT/KR2023/020447.
(Continued)

*Primary Examiner* — Kaj K Olsen
*Assistant Examiner* — Pradhuman Parihar
(74) *Attorney, Agent, or Firm* — Jefferson IP Law, LLP

(57) ABSTRACT

A vacuum cleaner system is provided. The vacuum cleaner includes a wireless vacuum cleaner for discharging dust to a station device, wherein the wireless vacuum cleaner is configured to, when performing a dust discharge operation to the station device, determine a state of a dust collection part included in the station device, based on a pressure ratio between pressure values measured by a sensor mounted on the wireless vacuum cleaner, and output a notification indicating the determined state.

20 Claims, 17 Drawing Sheets

(56) References Cited

U.S. PATENT DOCUMENTS

| | | | | |
|---|---|---|---|---|
| 2010/0154161 | A1 | 6/2010 | Takahashi et al. | |
| 2020/0281427 | A1* | 9/2020 | Buening | A47L 9/2852 |
| 2022/0160201 | A1* | 5/2022 | Cho | A47L 5/225 |
| 2022/0287535 | A1 | 9/2022 | Cargill et al. | |
| 2023/0200607 | A1 | 6/2023 | Kim et al. | |

FOREIGN PATENT DOCUMENTS

| | | | |
|---|---|---|---|
| EP | 02986194 | B1 | 10/2020 |
| JP | 2007-190302 | A | 8/2007 |
| JP | 2020-142066 | A | 9/2020 |
| JP | 6993937 | B2 | 1/2022 |
| JP | 2022-064937 | A | 4/2022 |
| KR | 10-0820063 | B1 | 4/2008 |
| KR | 10-1650179 | B1 | 8/2016 |
| KR | 10-2166773 | B1 | 10/2020 |
| KR | 10-2022-0092056 | A | 1/2022 |
| KR | 10-2376262 | B1 | 3/2022 |
| KR | 10-2022-0071811 | A | 5/2022 |

OTHER PUBLICATIONS

European Search Report dated Dec. 8, 2025, issued in European Application No. 23907554.2.

* cited by examiner

2001

OPERATION OF FIRST SUCTION MOTOR 107 OF WIRELESS VACUUM CLEANER 100

2002

OPERATION OF SECOND SUCTION MOTOR 206 OF STATION DEVICE 200

FIG. 7

| VALUE (Pa) OF DIFFERENCE BETWEEN PRESSURE VALUES | 751 OR MORE | 750-401 | 400 OR LESS |
|---|---|---|---|
| DETAILS | 1) FLOW PATH OF PIPE/ BRUSH DEVICE BLOCKED<br>2) FOREIGN MATERIALS CAUGHT IN BRUSH DEVICE<br>3) CLEAN PRE MOTOR FILTER/FIRST DUST COLLECTION PART | INSPECT BRUSH DEVICE | 1) INSPECT BRUSH DEVICE<br>2) CLEAN PRE MOTOR FILTER/FIRST DUST COLLECTION PART |

2002

OPERATION OF SECOND SUCTION MOTOR 206 OF STATION DEVICE 200

VACUUM CLEANER SYSTEM NOTIFYING STATE OF DUST COLLECTION PART AND OPERATING METHOD OF VACUUM CLEANER SYSTEM

CROSS-REFERENCE TO RELATED APPLICATION(S)

This application is a continuation application, claiming priority under § 365(c), of an International application No. PCT/KR2023/020447, filed on Dec. 12, 2023, which is based on and claims the benefit of a Korean patent application number 10-2022-0180889, filed on Dec. 21, 2022, in the Korean Intellectual Property Office, the disclosure of which is incorporated by reference herein in its entirety.

TECHNICAL FIELD

The disclosure relates to a vacuum cleaner system notifying a state of a dust collection part and an operating method of the vacuum cleaner system.

BACKGROUND ART

Vacuum cleaner systems that are being recently released include a wireless vacuum cleaner and a station device. The wireless vacuum cleaner is configured to use a battery as a power source instead of using a cable supplying power. The wireless vacuum cleaner includes a suction motor configured to generate suction power. The wireless vacuum cleaner may use the suction power generated by the suction motor to suck up dust and the like together with air from a cleaner head (brush device). The wireless vacuum cleaner includes a dust collection part collecting foreign materials separated from the sucked up air.

The station device may perform an operation of docking the wireless vacuum cleaner, an operation of charging the battery of the wireless vacuum cleaner, and an operation of discharging dust of the dust collection part of the wireless vacuum cleaner. The operation of discharging dust of the dust collection part of the wireless vacuum cleaner is an operation of discharging the dust of the dust collection part included in the wireless vacuum cleaner to a dust collection part of the station device by using the suction power generated by the suction motor included in the station device, when the wireless vacuum cleaner is docked to the station device.

Due to such an operation of discharging dust of the dust collection part of the wireless vacuum cleaner, it is required to notify a state of the dust collection part of the station device. The state of the dust collection part of the station device may include a normal state or a state in need of replacement.

The above information is presented as background information only to assist with an understanding of the disclosure. No determination has been made, and no assertion is made, as to whether any of the above might be applicable as prior art with regard to the disclosure.

DISCLOSURE

Technical Solution

Aspects of the disclosure are to address at least the above-mentioned problems and/or disadvantages and to provide at least the advantages described below. Accordingly, an aspect of the disclosure is to provide a wireless vacuum cleaner for discharging dust to a station device. The wireless vacuum cleaner may include a first dust collection part configured to collect dust introduced to the wireless vacuum cleaner. The wireless vacuum cleaner may include a first suction motor configured to generate suction power for collecting dust in the first dust collection part. The wireless vacuum cleaner may include a sensor mounted on a portion of a suction flow path of the wireless vacuum cleaner. The wireless vacuum cleaner may include at least one processor.

The at least one processor according to an embodiment of the disclosure may be configured to obtain, as a first pressure value, a pressure value measured by the sensor when a second suction motor of the station device operates while there is no dust in the first dust collection part and a second dust collection part of the station device.

The at least one processor may be configured to obtain, as a second pressure value, a pressure value measured by the sensor when a dust discharge operation in which dust of the first dust collection part is discharged to the second dust collection part of the station device is performed.

The at least one processor may be configured to detect a ratio of the second pressure value to the first pressure value. The at least one processor may be configured to determine a state of the second dust collection part according to the detected ratio. The at least one processor may be configured to output notification information indicating the determined state of the second dust collection part.

Additional aspects will be set forth in part in the description which follows and, in part, will be apparent from the description, or may be learned by practice of the presented embodiments.

In accordance with an aspect of the disclosure, a method of operating a wireless vacuum cleaner is provided. The wireless vacuum cleaner may include a sensor mounted on a portion of a suction flow path of the wireless vacuum cleaner for discharging dust to a station device, a first dust collection part configured to collect dust introduced to the wireless vacuum cleaner, and a first suction motor configured to generate suction power for collecting dust in the first dust collection part.

In accordance with an aspect of the disclosure, the method of operating the wireless vacuum cleaner may include obtaining, as a first pressure value, a pressure value measured by the sensor when a second suction motor of the station device operates while there is no dust in the first dust collection part and a second dust collection part of the station device.

In accordance with an aspect of the disclosure, the method may include obtaining, as a second pressure value, a pressure value measured by the sensor when a dust discharge operation in which dust of the first dust collection part is discharged to the second dust collection part of the station device is performed.

In accordance with an aspect of the disclosure, the method may include detecting a ratio of the second pressure value to the first pressure value.

In accordance with an aspect of the disclosure, the method may include detecting a state of the second dust collection part included in the station device according to the detected ratio.

In accordance with an aspect of the disclosure, the method may include outputting notification information indicating the state of the second dust collection part.

In accordance with an aspect of the disclosure, one or more non-transitory computer-readable recording media storing a program including instructions that, when executed by at least one processor of an electronic device, cause the electronic device to perform operations is provided. The operations may include obtaining, as a first pressure value, a pressure value measured by a sensor when a second suction motor of a station device operates while there is no dust in a first dust collection part and a second dust collection part of the station device. The operations may include obtaining, as a second pressure value, a pressure value measured by the sensor when a dust discharge operation in which dust of the first dust collection part is discharged to the second dust collection part of the station device is performed. The operations may include detecting a ratio of the second pressure value to the first pressure value. The operations may include determining a state of the second dust collection part included in the station device according to the detected ratio. The operations may include outputting notification information indicating the state of the second dust collection part.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which:

FIG. 7 illustrates a table related to a self-diagnosis of a wireless vacuum cleaner before a dust discharge operation is performed, according to an embodiment of the disclosure;

The same reference numerals are used to represent the same elements throughout the drawings.

MODE FOR INVENTION

Figure 1:
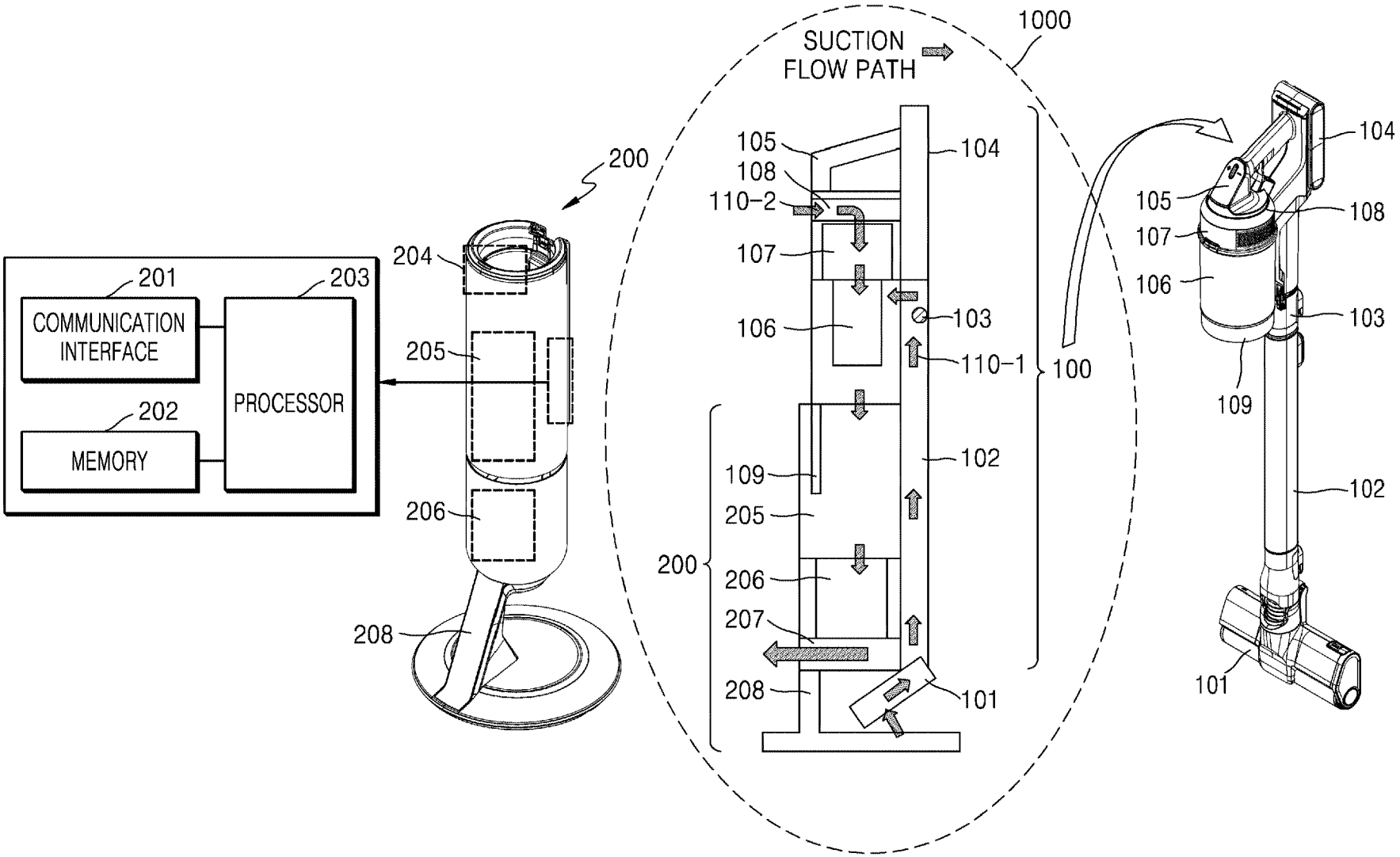
FIG. 1 is a diagram illustrating a vacuum cleaner system according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

All terms including descriptive or technical terms which are used herein should be construed as having meanings that are obvious to one of ordinary skill in the art. However, the terms may have different meanings according to the intention of one of ordinary skill in the art, precedent cases, or the appearance of new technologies. In addition, some terms may be arbitrarily selected by the applicant, and in this case, the meaning of the selected terms will be described in the detailed description of an embodiment of the disclosure.

Thus, the terms used herein have to be defined based on the meaning of the terms together with the description throughout the specification.

Throughout the disclosure, the expression "at least one of a, b, or c" indicates only a, only b, only c, both a and b, both a and c, both b and c, all of a, b, and c, or variations thereof.

In the disclosure, the term "and/or" includes any and all combinations of one or more of the associated listed items. In the disclosure, the terms, such as "first" and "second" may be used to distinguish one component from another component, and do not limit the components in another aspect (e.g., importance or order).

When a part "includes" or "comprises" an element, unless there is a particular description contrary thereto, the part may further include other elements, not excluding the other elements.

In addition, the terms, such as "unit", "-er/or", and "module" in the disclosure denote a unit performing at least one function or operation, and the "unit", "-er/or", or "module" may be realized as software or hardware, such as a field programmable gate array (FPGA) or application-specific integrated circuit (ASIC), or a combination of software and hardware. The term "unit" or "-er/or" used in an embodiment of the disclosure is not limited to software or hardware. The "unit" or "-er/or" in the disclosure may be configured so as to be in an addressable storage medium, or may be configured so as to operate one or more processors. According to an embodiment of the disclosure, the term "unit" or "-er/or" may refer to components, such as software components, object-oriented software components, class components, and task components, and may include processes, functions, attributes, procedures, subroutines, segments of program code, drivers, firmware, micro codes, circuits, data, a database, data structures, tables, arrays, or variables. Functions provided through a specific component or a specific "unit" or "-er/or" may be combined to reduce the number of the functions or may be separated into additional components. In addition, in an embodiment of the disclosure, the "unit" or "-er/or" may include at least one processor.

According to an embodiment of the disclosure, blocks in flowcharts or combinations of the flowcharts may be performed by computer program instructions. The computer program instructions may be mounted on a processor of a general-purpose computer, a special purpose computer, or another programmable data processing apparatus. Instructions performed through a processor of a computer or another programmable data processing apparatus may generate units for performing functions described in the flowchart block(s). The computer program instructions may be stored in computer-executable or computer-readable memory capable of directing a computer or another programmable data processing apparatus to implement a function in a particular manner. The instructions stored in the computer-executable or computer-readable memory may also be capable of producing manufacturing items containing instruction units for performing the functions described in the flowchart block(s). The computer program instructions may be mounted on a computer or another programmable data processing apparatus.

In addition, each block of the flowchart may represent a portion of a module, segment, or code that includes one or more executable instructions for executing specified logical function(s). In an embodiment of the disclosure, functions described in the blocks may be performed out of order. For example, two blocks illustrated successively may be executed substantially concurrently, or may be performed in a reverse order according to a function.

Hereinafter, an embodiment of the disclosure will be described with reference to the accompanying drawings such that one of ordinary skill in the art may easily implement the embodiment of the disclosure. However, an embodiment of the disclosure may be implemented in various different forms and is not limited to an embodiment of the disclosure described herein. In addition, in the drawings, parts irrelevant to the description are omitted in order to clearly describe an embodiment of the disclosure, and like reference numerals designate like elements throughout the specification.

According to an embodiment of the disclosure, provided are a vacuum cleaner system and an operating method of the vacuum cleaner system, wherein a state of a dust collection part of a station device is notified based on a ratio of a pressure value measured by a sensor mounted on (or provided at) a portion of a suction flow path (or a flow path) of a wireless vacuum cleaner when dust of a dust collection part of the wireless vacuum cleaner is discharged to the station device.

According to an embodiment of the disclosure, provided are a wireless vacuum cleaner and an operating method of the wireless vacuum cleaner, wherein a state of a dust collection part of a station device is notified based on a ratio of a pressure value measured by a sensor mounted on a portion of a suction flow path of the wireless vacuum cleaner when dust of a dust collection part of the wireless vacuum cleaner is discharged to the station device.

According to an embodiment of the disclosure, provided are a wireless vacuum cleaner and an operating method of the wireless vacuum cleaner, wherein a state of a dust collection part of a station device is notified based on a change rate of a pressure value measured by a sensor mounted on a portion of a suction flow path of the wireless vacuum cleaner when dust of a dust collection part of the wireless vacuum cleaner is discharged to the station device.

According to an embodiment of the disclosure, a structure of a vacuum cleaner system determining a state of a dust collection part included in a station device may be simplified, and thus, manufacturing costs of the vacuum cleaner system may be reduced.

According to an embodiment of the disclosure, provided are a vacuum cleaner system and an operating method of the vacuum cleaner system, wherein a self-diagnosis on a wireless vacuum cleaner is performed based on a change rate of a pressure value measured by a sensor mounted on a portion of a suction flow path of the wireless vacuum cleaner is performed, and a state of a dust collection part of a station device is notified based on a ratio between pressure values measured by a sensor mounted on the station device when dust of a dust collection part of the wireless vacuum cleaner is discharged to the station device.

According to an embodiment of the disclosure, provided are a wireless vacuum cleaner and an operating method of the wireless vacuum cleaner, wherein a self-diagnosis on the wireless vacuum cleaner is performed based on a change rate of a pressure value measured by a sensor mounted on a portion of a suction flow path of the wireless vacuum cleaner is performed, and a state of a dust collection part of a station device is notified based on a ratio between pressure values measured by a sensor mounted on the station device when dust of a dust collection part of the wireless vacuum cleaner is discharged to the station device.

FIG. 1 is a diagram illustrating a vacuum cleaner system according to an embodiment of the disclosure.

Referring to FIG. 1, a vacuum cleaner system 1000 is configured to determine a state of a second dust collection part 205 included in a station device 200 by using a pressure value measured by a sensor 103 mounted on a wireless vacuum cleaner 100, when dust of a first dust collection part 106 of the wireless vacuum cleaner 100 is discharged to the second dust collection part 205 of the station device 200.

The state of the second dust collection part 205 included in the station device 200, according to an embodiment of the disclosure, may denote a state based on a contamination level of the second dust collection part 205. For example, the state of the second dust collection part 205 may include a normal state in which the second dust collection part 205 is not contaminated or the contamination level is low. For example, the state of the second dust collection part 205 may include a state (or pre-replacement notification state) in which the contamination level of the second dust collection part 205 requires prior notification of replacement of the second dust collection part 205. For example, the state of the second dust collection part 205 may include a state (or a replacement notification state) in which the contamination level of the second dust collection part 205 requires notification of replacement of the second dust collection part 205. For example, the state of the second dust collection part 205 may include a state (or a motor operation stop state) in which the contamination level of the second dust collection part 205 requires an operation of the second suction motor 206 to be stopped in order to protect the second suction motor 206 of the station device 200. The state of the second dust collection part 205, according to an embodiment of the disclosure, is not limited thereto.

When the wireless vacuum cleaner 100 is docked to the station device 200 and performs an operation (a dust discharge operation) of discharging dust of the first dust collection part 106 included in the wireless vacuum cleaner 100 to the second dust collection part 205 included in the station device 200, the second suction motor 206 of the station device 200 is driven, and thus, the vacuum cleaner system 1000 according to an embodiment of the disclosure may form suction flow paths 110-1 and 110-2 between the wireless vacuum cleaner 100 and the station device 200.

In a case where the dust discharge operation is performed when a dust discharge cover 109 is opened as the second suction motor 206 of the station device 200 is driven, while there is no dust in the first dust collection part 106 of the wireless vacuum cleaner 100 and the second dust collection part 205 of the station device 200, the wireless vacuum cleaner 100 according to an embodiment of the disclosure may obtain a pressure value measured by the sensor 103 as a first pressure value of the suction flow paths 110-1 and 110-2 formed between the wireless vacuum cleaner 100 and the station device 200. The first pressure value may be referred to as an initial pressure value of the suction flow paths 110-1 and 110-2 formed between the wireless vacuum cleaner 100 and the station device 200 when the dust discharge operation is performed. The first pressure value may be used by being pre-stored in the wireless vacuum cleaner 100 or the station device 200. When the first pressure value is used by being pre-stored in the wireless vacuum cleaner 100 or the station device 200, the wireless vacuum cleaner 100 may not perform an operation of obtaining the first pressure value. When the first pressure value is used by being pre-stored in the wireless vacuum cleaner 100 or the station device 200, the first pressure value may be shared between the wireless vacuum cleaner 100 and the station device 200, based on communication between the wireless vacuum cleaner 100 and the station device 200.

When the dust discharge operation in which the dust of the first dust collection part 106 of the wireless vacuum cleaner 100 is discharged to the second dust collection part 205 of the station device 200 is performed, the wireless vacuum cleaner 100 according to an embodiment of the disclosure may obtain a pressure value measured by the sensor 103 as a second pressure value of the suction flow paths 110-1 and 110-2 formed between the wireless vacuum cleaner 100 and the station device 200. Here, suction power of the suction flow paths 110-1 and 110-2 is generated by an operation of the second suction motor 206 of the station device 200.

The wireless vacuum cleaner 100 according to an embodiment of the disclosure may detect a ratio between the first pressure value and the second pressure value. The detected ratio between the first pressure value and the second pressure value may be referred to as a ratio of suction power when the dust discharge operation of the vacuum cleaner system 1000 is performed. The wireless vacuum cleaner 100 according to an embodiment of the disclosure may detect a difference between the first pressure value and the second pressure value. The difference between the first pressure value and the second pressure value may be referred to as a pressure change rate. The pressure change rate may be referred to as a change rate of the suction power.

The wireless vacuum cleaner 100 according to an embodiment of the disclosure may determine a state of the second dust collection part 205 included in the station device 200, according to the detected ratio between the first pressure value and the second pressure value. The wireless vacuum cleaner 100 according to an embodiment of the disclosure may output notification information indicating the determined state of the second dust collection part 205 to at least one of a user interface 105 included in the wireless vacuum cleaner 100, the station device 200, a user terminal 400 shown in FIG. 8 described below, or a server device 500. The user terminal 400 and the server device 500 may be referred to as external devices of the wireless vacuum cleaner 100.

The wireless vacuum cleaner 100 according to an embodiment of the disclosure may determine the state of the second dust collection part 205 included in the station device 200, according to the detected difference (pressure change rate) between the first pressure value and the second pressure value.

The wireless vacuum cleaner 100 according to an embodiment of the disclosure may include a brush device 101, a pipe 102, the sensor 103, a battery 104, the user interface 105, the first dust collection part 106, a first suction motor 107, an exhaust port 108, and the dust discharge cover 109. A portion of the wireless vacuum cleaner 100, which includes components other than the brush device 101 and the pipe 102, may be referred to as a cleaner body 300 shown in FIG. 3 to be described below. The cleaner body 300 will be described below with reference to FIG. 3. The wireless vacuum cleaner 100 may include the brush device 101, the pipe 102, and the cleaner body 300. The brush device 101 and the pipe 102 may be detached from the wireless vacuum cleaner 100.

Components of the wireless vacuum cleaner 100 are not limited to those shown in FIG. 1. The wireless vacuum cleaner 100 may include more components than those shown in FIG. 1. The wireless vacuum cleaner 100 may include fewer components than those shown in FIG. 1. For example, the wireless vacuum cleaner 100 may further include a communication interface 330 capable of communicating with the station device 200 or the user terminal 400. For example, the wireless vacuum cleaner 100 may not include the pipe 102. When the wireless vacuum cleaner 100 does not include the pipe 102, the wireless vacuum cleaner 100 may be referred to as a handy type wireless vacuum cleaner. In this case, the wireless vacuum cleaner 100 may include the brush device 101 and the cleaner body 300.

The brush device 101 may suck up dust or foreign materials (e.g., dust, hair, trash) from a surface to be cleaned. The brush device 101 may also be referred to as a cleaner head. The brush device 101 may be rotatably combined with the pipe 102. The brush device 101 may include a motor, a drum to which a rotating brush is attached, or the like, but is not limited thereto. The brush device 101 may be configured in various types.

The pipe 102 may connect the brush device 101 and the first dust collection part 106 to a suction flow path (or a first suction flow path) 110-1. The pipe 102 may be referred to as an extension pipe. The pipe 102 may be configured as a pipe having certain rigidity or a flexible hose. The pipe 102 may transmit the suction power generated by the first suction motor 107 to the brush device 101, and move the air and foreign materials sucked up through the brush device 101 to the cleaner body 300.

The sensor 103 according to an embodiment of the disclosure may be mounted on a portion of the suction flow path (or the first suction flow path) 110-1 of the wireless vacuum cleaner 100 to measure a pressure value. The sensor 103 may transmit the measured pressure value to a processor 310 included in the wireless vacuum cleaner 100. The sensor 103 may transmit, to the processor 310, the pressure value measured through inter integrated circuit (I2C) communication.

The suction flow paths 110-1 and 110-2 according to an embodiment of the disclosure may indicate a section from a location where suction of air including foreign materials starts to a location where the air from which the foreign materials are removed is discharged. For example, the suction flow path 110-1 of the wireless vacuum cleaner 100 is an entire section between an inlet port of the brush device 101 and the exhaust port 108, and will be referred to as a first suction flow path 110-1 for convenience of description. The first suction flow path 110-1 may be formed by the suction power according to an operation of the first suction motor 107 included in the wireless vacuum cleaner 100.

The sensor 103 according to an embodiment of the disclosure may be mounted on a portion of a suction duct 40 of the wireless vacuum cleaner 100 as will be described with reference to FIG. 3 below, or may be mounted on a portion of the entire section of the first suction flow path 110-1 of the wireless vacuum cleaner 100. For example, the sensor 103 may be mounted within the first dust collection part 106. For example, the sensor 103 may be mounted on a location adjacent to the first suction motor 107.

The wireless vacuum cleaner 100 may obtain, as a pressure value of the first suction flow path 110-1 of the wireless vacuum cleaner 100, the pressure value measured by the sensor 103 when the wireless vacuum cleaner 100 is not docked to the station device 200. The wireless vacuum cleaner 100 may obtain, as the pressure value of the first suction flow path 110-1, the pressure value measured by the sensor 103 when the wireless vacuum cleaner 100 is docked to the station device 200 but the dust discharge cover 109 is not opened (or the dust discharge operation is not performed). Here, suction power of the first suction flow path 110-1 may be generated by the first suction motor 107.

The pressure value measured by the sensor 103 when the first suction motor 107 operates while there is no dust in the first dust collection part 106 of the wireless vacuum cleaner 100, before the dust discharge operation is performed, may be obtained as a third pressure value of the first suction flow path 110-1. The third pressure value may be referred to as an initial pressure value of the first suction flow path 110-1 when the first suction motor 107 operates while there is no dust in the first dust collection part 106 of the wireless vacuum cleaner 100, before the dust discharge operation is performed.

The pressure value measured by the sensor 103 while dust is collected in the first dust collection part 106 when the first suction motor 107 operates may be obtained as a fourth pressure value of the first suction flow path 110-1. The wireless vacuum cleaner 100 may perform a self-diagnosis on the wireless vacuum cleaner 100 by using a difference between the third pressure value of the first suction flow path 110-1 and the fourth pressure value of the first suction flow path 110-1. The self-diagnosis on the wireless vacuum cleaner 100 may diagnose a contaminated state of the first dust collection part 106, a blocked state of the first suction flow path 110-1 of the wireless vacuum cleaner 100 (e.g., whether the brush device 101 is blocked, whether the pipe 102 is blocked, or whether the exhaust port 108 is blocked), an inspection position of the wireless vacuum cleaner 100 (e.g., the brush device 101, the pipe 102, the first dust collection part 106, a pre motor filter 1300, and the like), or whether an operation of the wireless vacuum cleaner 100 is in a normal state, but self-diagnostic items of the wireless vacuum cleaner 100 are not limited thereto.

For example, when the difference between the third pressure value of the first suction flow path 110-1 of the wireless vacuum cleaner 100 and the fourth pressure value of the first suction flow path 110-1 is 750 to 401 pascal (Pa), the wireless vacuum cleaner 100 may determine that the first suction flow path 110-1 is not blocked and the contamination level of the first dust collection part 106 is zero or a low normal state.

For example, when the difference between the third pressure value of the first suction flow path 110-1 of the wireless vacuum cleaner 100 and the fourth pressure value of the first suction flow path 110-1 is 401 Pa or less, the wireless vacuum cleaner 100 may determine that the first dust collection part 106 is in a state that requires cleaning (or a state that requires inspection or a state that requires dust discharge (or dust removal)).

For example, when the difference between the third pressure value of the first suction flow path 110-1 of the wireless vacuum cleaner 100 and the fourth pressure value of the first suction flow path 110-1 is 751 Pa or more, the wireless vacuum cleaner 100 may determine that a flow path of the brush device 101 or a flow path of the pipe 102 is blocked.

The wireless vacuum cleaner 100 may obtain, as a pressure value of the suction flow paths 110-1 and 110-2 formed between the wireless vacuum cleaner 100 and the station device 200, a pressure value measured by the sensor 103 when the dust discharge cover 109 is opened as the wireless vacuum cleaner 100 is docked to the station device 200 and the dust discharge operation in which dust of the first dust collection part 106 is discharged to the second dust collection part 205 is performed as the second suction motor 206 operates. Hereinafter, the suction flow paths 110-1 and 110-2 formed between the wireless vacuum cleaner 100 and the station device 200 will be referred to as a second suction flow path 110-1, 110-2 for convenience of description. The second suction flow path 110-1, 110-2 may include the suction flow path 110-1 from the inlet port of the brush device 101 of the wireless vacuum cleaner 100 to an exhaust port 207 of the station device 200 through the first dust collection part 106 of the wireless vacuum cleaner 100, and a suction flow path 110-2 from the exhaust port 108 of the wireless vacuum cleaner 100 to the exhaust port 207 of the station device 200. An operation of obtaining a pressure value of the second suction flow path 110-1, 110-2 may be performed when the suction power is generated according to an operation of the second suction motor 206 included in the station device 200, but is not limited thereto.

The wireless vacuum cleaner 100 may obtain, as the first pressure value of the second suction flow path 110-1, 110-2, a pressure value measured by the sensor 103 as the dust discharge cover 109 is opened and the second suction motor 206 operates when there is no dust in the first dust collection part 106 and the second dust collection part 205. The first pressure value of the second suction flow path 110-1, 110-2 may be used by being pre-stored in the wireless vacuum cleaner 100.

The wireless vacuum cleaner 100 may obtain, as the second pressure value of the second suction flow path 110-1, 110-2, a pressure value measured by the sensor 103 when the dust discharge operation in which the dust of the first dust collection part 106 is discharged to the second dust collection part 205 is performed.

The wireless vacuum cleaner 100 may detect a pressure ratio of the second suction flow path 110-1, 110-2 by using the first pressure value and the second pressure value of the second suction flow paths 110-1, 110-2. The wireless vacuum cleaner 100 may determine a state of the second dust collection part 205 included in the station device 200 according to the detected pressure ratio of the second suction flow path 110-1, 110-2. For example, the state of the second dust collection part 205 included in the station device 200 may be determined according to whether the pressure ratio of the second suction flow path 110-1, 110-2 is a first threshold value (e.g., 60%) or more, is less than the first threshold value (e.g., 60%) but is a second threshold value (e.g., 40%) or more, the second threshold value being less than the first threshold value, is less than the second threshold value (e.g., 40%) but is a third threshold value (e.g., 20%) or more, the third threshold value being less than the second threshold value, or is less than the third threshold value (e.g., 20%).

For example, when a ratio between the first pressure value and the second pressure value of the second suction flow path 110-1, 110-2 is the first threshold value (e.g., 60%) or more, the wireless vacuum cleaner 100 may determine the state of the second dust collection part 205 included in the station device 200 as a normal state. For example, when the ratio between the first pressure value and the second pressure value of the second suction flow path 110-1, 110-2 is less than the first threshold value (e.g., 60%) but is the second threshold value (e.g., 40%) or more, the second threshold value being less than the first threshold value, the wireless vacuum cleaner 100 may determine the state of the second dust collection part 205 included in the station device 200 as a state that replacement of the second dust collection part 205 needs to be pre-notified (or a pre-replacement notification state). For example, when the ratio between the first pressure value and the second pressure value of the second suction flow path 110-1, 110-2 is less than the second threshold value (e.g., 40%) but is the third threshold value (e.g., 20%) or more, the wireless vacuum cleaner 100 may determine the state of the second dust collection part 205 included in the station device 200 as a state that replacement of the second dust collection part 205 needs to be notified (or a replacement notification state). For example, when the ratio between the first pressure value and the second pressure value of the second suction flow path 110-1, 110-2 is less than the third threshold value (e.g., 20%), the wireless vacuum cleaner 100 may determine the state of the second dust collection part 205 as a state that an operation of the second suction motor 206 included in the station device 200 needs to be stopped (or an operation stop state of the second suction motor 206). Accordingly, damage to the second suction motor 206 caused by contamination of the second dust collection part 205 included in the station device 200 may be prevented.

When a blockage of the first suction flow path 110-1 is detected as a result of performing a self-diagnosis, based on the pressure value measured by the sensor 103, the wireless vacuum cleaner 100 may perform the dust discharge operation after the blockage of the first suction flow path 110-1 is resolved. When the blockage of the first suction flow path 110-1 is detected as a result of performing the self-diagnosis, based on the pressure value measured by the sensor 103, the wireless vacuum cleaner 100 may obtain a pressure value of the second suction flow path 110-1, 110-2 after the blockage of the first suction flow path 110-1 is resolved. The blockage of the first suction flow path 110-1 may be resolved by a user. When the blockage of the first suction flow path 110-1 is not resolved, the wireless vacuum cleaner 100 may not perform a state notification operation of the second dust collection part 205 of the station device 200 according to an embodiment of the disclosure.

The wireless vacuum cleaner 100 according to an embodiment of the disclosure may apply a correction range to the pressure value measured by the sensor 103 when the state notification operation of the second dust collection part 205 of the station device 200 is performed while the blockage of the first suction flow path 110-1 is not resolved. Accordingly, accuracy of the state notification operation of the second dust collection part 205 of the station device 200 may be prevented from being deteriorated. The correction range may be determined based on the pressure value of the first suction flow path 110-1, measured by the sensor 103, according to the blockage of the first suction flow path 110-1 of the wireless vacuum cleaner 100, but is not limited thereto.

The wireless vacuum cleaner 100 may not perform the state notification operation of the second dust collection part 205 of the station device 200 during a transient duration that may occur when the station device 200 performs the dust discharge operation. The transient duration is an initial duration among a dust discharge duration in which dust in the first dust collection part 106 of the wireless vacuum cleaner 100 is discharged to the second dust collection part 205 of the station device 200, and may be pre-set. For example, the transient duration may be determined by using a pressure value measured by the sensor 103. The wireless vacuum cleaner 100 may perform the state notification operation of the second dust collection part 205 of the station device 200 in a stable duration of the dust discharge operation. The stable duration may be defined as a duration in which the transient duration is excluded from an entire duration of the dust discharge operation. The wireless vacuum cleaner 100 may perform the state notification operation of the second dust collection part 205 of the station device 200 in a duration before the dust discharge operation is ended.

The wireless vacuum cleaner 100 may obtain the second pressure value of the second suction flow path 110-1, 110-2 between the wireless vacuum cleaner 100 and the station device 200 in at least one of a dust discharge operation duration, the duration before the dust discharge operation is ended, or the stable duration of the dust discharge operation. The second pressure value may be defined as a pressure value of the second suction flow path 110-1, 110-2, which is detected during the dust discharge operation.

The sensor 103 according to an embodiment of the disclosure is not limited to a pressure sensor. For example, the sensor 103 may include a flow sensor. The wireless vacuum cleaner 100 may obtain a flow value of the first suction flow path 110-1 or a variance in a flow of the second suction flow path 110-1, 110-2, by using a sensing value measured by the sensor 103.

The battery 104 may be configured as a chargeable battery. The battery 104 may be wirelessly charged when the wireless vacuum cleaner 100 is docked to the station device 200. The battery 104 may be configured to be electrically connected to a charging terminal provided in the station device 200, when the wireless vacuum cleaner 100 is docked to the station device 200. The battery 104 may be charged by receiving power from the charging terminal. The battery 104 may supply power to all components of the wireless vacuum cleaner 100. The battery 104 may be detachably mounted on the wireless vacuum cleaner 100.

The wireless vacuum cleaner 100 may output notification information about a self-diagnosis result (e.g., a contaminated state of the first dust collection part 106 or whether the first suction flow path 110-1 is blocked) or a state (or a contaminated state) of the second dust collection part 205 included in the station device 200. For example, the wireless vacuum cleaner 100 may output the notification information to the user interface 105. For example, the wireless vacuum cleaner 100 may transmit the notification information to the station device 200. For example, the wireless vacuum cleaner 100 may transmit the notification information to the user terminal 400 or the server device 500. The user terminal 400 or the server device 500 may be referred to as external devices. The external devices are not limited to the user terminal 400 and the server device 500.

The user interface 105 may be provided at a handle of the wireless vacuum cleaner 100. The user interface 105 may include an input interface and an output interface. The wireless vacuum cleaner 100 may receive a user input related to an operation of the wireless vacuum cleaner 100 through the user interface 105. The wireless vacuum cleaner 100 may output information related to an operation of the wireless vacuum cleaner 100 through the user interface 105. The wireless vacuum cleaner 100 may output, through the user interface 105, information about a state in which the wireless vacuum cleaner 100 is docked to the station device 200, information about a state (or a contaminated state) of the first dust collection part 106, information about a self-diagnosis result of the wireless vacuum cleaner 100, or information about a state (or a contaminated state) of the second dust collection part 205.

The input interface may include a power button, a button for adjusting suction power strength of the wireless vacuum cleaner 100, and the like. The output interface may include a light-emitting diode (LED) display, a liquid crystal display (LCD), or a touch screen, but is not limited thereto. For example, the LED display included in the output interface may emit light from a green LED when the state of the second dust collection part 205 is a normal state. For example, the LED display included in the output interface may emit light from a yellow LED when the state of the second dust collection part 205 is a pre-replacement notification state(or pre-replacement reminder state). For example, the LED display included in the output interface may emit light from a red LED when the state of the second dust collection part 205 is a replacement notification state (or replacement reminder state). The output interface may output an operation stop message of the second suction motor 206 when the second suction motor 206 stops operating. The output interface may output the above-described states of the second dust collection part 205 in speech or an audio signal. The output interface may output LED light emission together with the speech or audio signal.

The first dust collection part 106 may collect foreign materials sucked up from a surface to be cleaned through the brush device 101 by the suction power generated by the first suction motor 107. The first dust collection part 106 may be referred to as a dust container. The first dust collection part 106 may be configured to be detachable. The first suction motor 107 may generate the suction power such that a vacuum is formed inside the wireless vacuum cleaner 100. The exhaust port 108 of the wireless vacuum cleaner 100 may discharge air from which the foreign materials are removed. The exhaust port 108 may include a filter portion 1300 including an exhaust filter or a pre motor filter.

The dust discharge cover 109 may be opened when the dust discharge operation of the station device 200 is performed. The dust discharge cover 109 may be opened according to an operation of the second suction motor 206, but is not limited thereto. The dust discharge cover 109 may be manually opened according to a user command. The dust discharge cover 109 may be automatically opened when docking of the wireless vacuum cleaner 100 to the station device 200 is recognized. The dust discharge cover 109 may be opened based on a contaminated state of the first dust collection part 106 of the wireless vacuum cleaner 100. The dust discharge cover 109 may be opened based on communication between the wireless vacuum cleaner 100 and the station device 200. The dust discharge cover 109 shown in FIG. 1 is in an opened state. A closed state of the dust discharge cover 109 will be described below with reference to FIG. 2.

The station device 200 shown in FIG. 1 may be configured to perform a docking operation of the wireless vacuum cleaner 100, an operation of charging the battery 104 of the wireless vacuum cleaner 100, and the dust discharge operation of the first dust collection part 106 of the wireless vacuum cleaner 100. The station device 200 may also be referred to as a cleaning station.

The station device 200 shown in FIG. 1 may include a communication interface 201, memory 202, a processor 203, a user interface 204, the second dust collection part 205, the second suction motor 206, the exhaust port 207, and a support 208, but is not limited thereto. For example, the station device 200 may include the charging terminal to which the battery 104 may be connected. For example, the station device 200 may include an opening or closing device for opening or closing the dust discharge cover 109. For example, when the station device 200 is configured as a wall-mounted type, the station device 200 may not include the support 208.

The communication interface 201 may perform communication between the station device 200 and the wireless vacuum cleaner 100. The communication between the station device 200 and the wireless vacuum cleaner 100 may be referred to as communication between the station device 200 and the cleaner body 300. The communication interface 201 may perform communication between the station device 200 and the server device 500 shown in FIG. 8. The communication interface 201 may perform communication between the station device 200 and the user terminal 400 shown in FIG. 8. The communication interface 201 may communicate with the wireless vacuum cleaner 100 through a first communication scheme (e.g., a Bluetooth low energy (BLE) communication scheme) and communicate with the server device 500 and the user terminal 400 through a second communication scheme (e.g., Wi-Fi communication scheme).

The communication interface 201 may include a short-range wireless communication interface, a long-range wireless communication interface, and the like.

The short-range wireless communication interface may include a Bluetooth communication interface, a Bluetooth low energy (BLE) communication interface, a near field communication (NFC) interface, a wireless local area network (WLAN) (Wi-Fi) communication interface, a Zigbee communication interface, an infrared data association (IrDA) communication interface, a Wi-Fi direct (WFD) communication interface, an ultra-wideband (UWB) communication interface, or an Ant+ communication interface, but is not limited thereto. The long-range wireless communication interface may be used by the station device 200 to remotely communicate with the server device 500. The long-range wireless communication interface may include the Internet, a computer network (e.g., a local area network (LAN) or a wide area network (WAN)), and a mobile communicator. The mobile communicator may include a 3rd generation (3G) module, a 4th generation (4G) module, a 5th generation (5G) module, a long-tern evolution (LTE) module, a node B (NB)-Internet of things (IoT) module, an LTE-machine type communication (LTE-M) module, but is not limited thereto.

The communication interface 201 may transmit data to the processor 203 through a universal asynchronous receiver/transmitter (UART), but is not limited thereto.

The memory 202 of the station device 200 may store a program (e.g., one or more instructions) for processing and control by the processor 203, or store pieces of input/output data. For example, the memory 202 of the station device 200 may store software related to control by the station device 200, state data of the second suction motor 206, error occurrence data (malfunction history data), and the like, but is not limited thereto.

The memory 202 of the station device 200 may store data received from the wireless vacuum cleaner 100. For example, the station device 200 may store product information (e.g., identification information and model information) of the wireless vacuum cleaner 100 docked to the station device 200, information about a software version installed in the wireless vacuum cleaner 100, error occurrence data (malfunction history data) of the wireless vacuum cleaner 100, and the like.

The memory 202 may include at least one type of storage medium among a flash memory type, a hard disk type, a multimedia card micro type, card type memory (for example, a secure digital (SD) or extreme digital (XD) memory, or the like), random access memory (RAM), static RAM (SRAM), read-only memory (ROM), electrically erasable programmable ROM (EEPROM), programmable ROM (PROM), magnetic memory, a magnetic disk, and an optical disk. Programs stored in the memory 202 may be classified into a plurality of modules depending on functions.

The station device 200 may include the processor 203. The station device 200 may include one processor or a plurality of processors. In addition, the processor 203 may be referred to as at least one processor. The processor 203 according to an embodiment of the disclosure may include at least one circuitry, such as a central processing unit (CPU), a graphics processing unit (GPU), an accelerated processing unit (APU), a many integrated core (MIC), a digital signal processor (DSP), or a neural processing unit (NPU). The processor 203 may be implemented in the form of an integrated system-on-chip (SoC) including one or more electronic components. When the processor 203 is configured as a plurality of processors, the plurality of processors may be realized as separate pieces of hardware (H/W). The processor 203 may be referred to as a micro-processor controller (MICOM), a micro-processor unit (MPU), or a micro-controller unit (MCU).

The processor 203 according to an embodiment of the disclosure may be implemented as a single core processor or a multicore processor.

The processor 230 may control all operations of the station device 200. For example, the processor 203 may control the communication interface 201 to receive, from the server device 500, a new version of software related to control by the wireless vacuum cleaner 100, and store the received new version of software in the memory 202. The processor 203 may download, to the wireless vacuum cleaner 100 through the communication interface 201, the new version of software.

The user interface 204 of the station device 200 may include an input interface and an output interface. The input interface may include a discharge button, a mode selecting button, and the like. The output interface may include an LED display, an LCD, or a touch screen, but is not limited thereto. The output interface may display a charged amount of the battery 104 of the wireless vacuum cleaner 100, software update progress information, or the like but is not limited thereto. The user interface 105 may output, as in the user interface 105, information indicating a state of the second dust collection part 205 of the station device 200, which is transmitted from the wireless vacuum cleaner 100.

The second dust collection part 205 of the station device 200 may collect foreign materials discharged from the first dust collection part 106 by using the suction power generated when the second suction motor 206 is operated. The second dust collection part 205 may be configured in the form of a dust container or a dust bag. The second dust collection part 205 may be configured in a replaceable structure.

The second suction motor 206 may be a device generating suction power for discharging foreign materials collected in the first dust collection part 106 of the wireless vacuum cleaner 100 to the second dust collection part 205. The second suction motor 206 may be a device generating suction power for moving the air. The second suction motor 206 may rotate a suction fan moving the air.

The second suction motor 206 may be operated according to a user command. The user command may be received through the user interface 204 included in the station device 200. The user command may be transmitted from an external device (e.g., the wireless vacuum cleaner 100, the user terminal 400, or the server device 500) through the communication interface 201 included in the station device 200. The second suction motor 206 may be automatically operated when the wireless vacuum cleaner 100 is docked to the station device 200.

The support 208 may provide an accommodation space where the brush device 101 of the wireless vacuum cleaner 100 is accommodated. A power supply device may be provided in the support 208.

The vacuum cleaner system 1000 according to an embodiment of the disclosure is not limited to that shown in FIG.

1. The vacuum cleaner system 1000 may include more components than those shown in FIG. 1. The vacuum cleaner system 1000 may include fewer components than those shown in FIG. 1. For example, the vacuum cleaner system 1000 may further include the server device 500 and the user terminal 400 described below with reference to FIG. 8. For example, the vacuum cleaner system 1000 may be implemented as the wireless vacuum cleaner 100.

Referring to FIG. 1, the second suction flow path 110-1, 110-2 is formed when the dust discharge cover 109 is opened.

Figure 2:
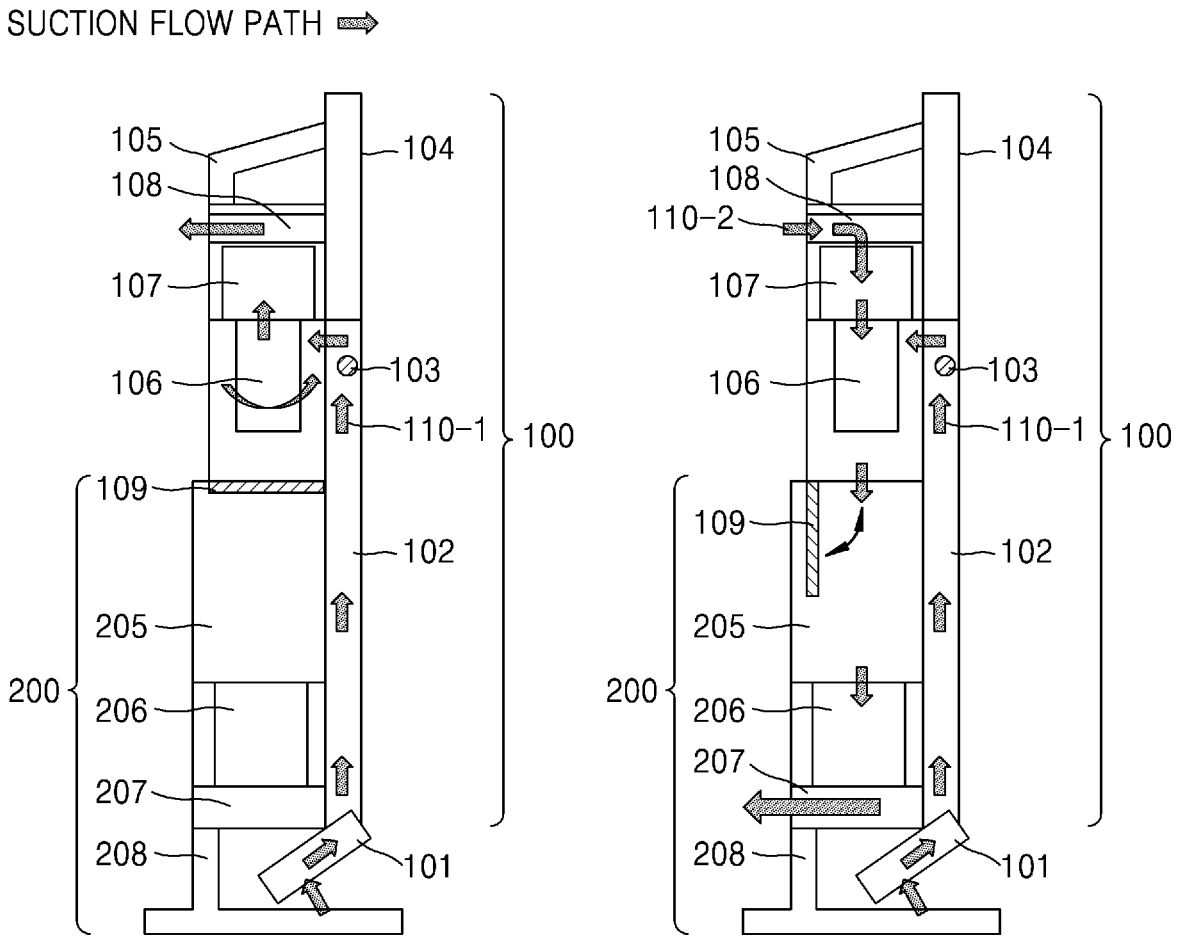
FIG. 2 is a diagram illustrating a first suction flow path and a second suction flow path of a vacuum cleaner system according to an embodiment of the disclosure.

FIG. 2 is a diagram illustrating first suction flow path and a second suction flow path of a vacuum cleaner system according to an embodiment of the disclosure.

Referring to FIG. 2, a case 2001 is where the wireless vacuum cleaner 100 is docked to the station device 200 but the dust discharge cover 109 of the wireless vacuum cleaner 100 is closed, and thus, the dust discharge operation is not performed. Accordingly, the case 2001 is an example in which the first suction flow path 110-1 described with reference to FIG. 1 of the wireless vacuum cleaner 100 is formed. In the case 2001, suction power may be generated by the first suction motor 107 included in the wireless vacuum cleaner 100. When the first suction flow path 110-1 of the wireless vacuum cleaner 100 is formed as in the case 2001, the wireless vacuum cleaner 100 may obtain a pressure value measured by the sensor 103 as a value of the first suction flow path 110-1 of the wireless vacuum cleaner 100, and perform a self-diagnosis on the wireless vacuum cleaner 100 (e.g., whether the first suction flow path 110-1 is blocked, an inspection position of the wireless vacuum cleaner 100 (or a blocked location of the first suction flow path 110-1), or a contaminated state of the first dust collection part 106), based on the obtained pressure value of the first suction flow path 110-1 of the wireless vacuum cleaner 100.

A case 2002 of FIG. 2 is where the wireless vacuum cleaner 100 is docked to the station device 200 and the dust discharge cover 109 of the wireless vacuum cleaner 100 is opened, and thus, the dust discharge operation is performed. Accordingly, the case 2002 is an example in which the second suction flow path 110-1, 110-2 (the second suction flow path described with reference to FIG. 1) are formed between the wireless vacuum cleaner 100 and the station device 200. In the case 2002, suction power may be generated by the second suction motor 206 included in the station device 200. When the second suction flow path 110-1, 110-2 are formed between the wireless vacuum cleaner 100 and the station device 200 as shown in the case 2002, the wireless vacuum cleaner 100 may obtain a pressure value measured by the sensor 103 as a pressure value of the second suction flow path 110-1, 110-2 between the wireless vacuum cleaner 100 and the station device 200, detect a pressure ratio or pressure change rate (or a pressure difference) of the second suction flow path 110-1, 110-2 between the wireless vacuum cleaner 100 and the station device 200 by using the obtained pressure value, and determine a state of the second dust collection part 205 included in the station device 200, based on the detected pressure ratio or pressure change rate.

Figure 3:
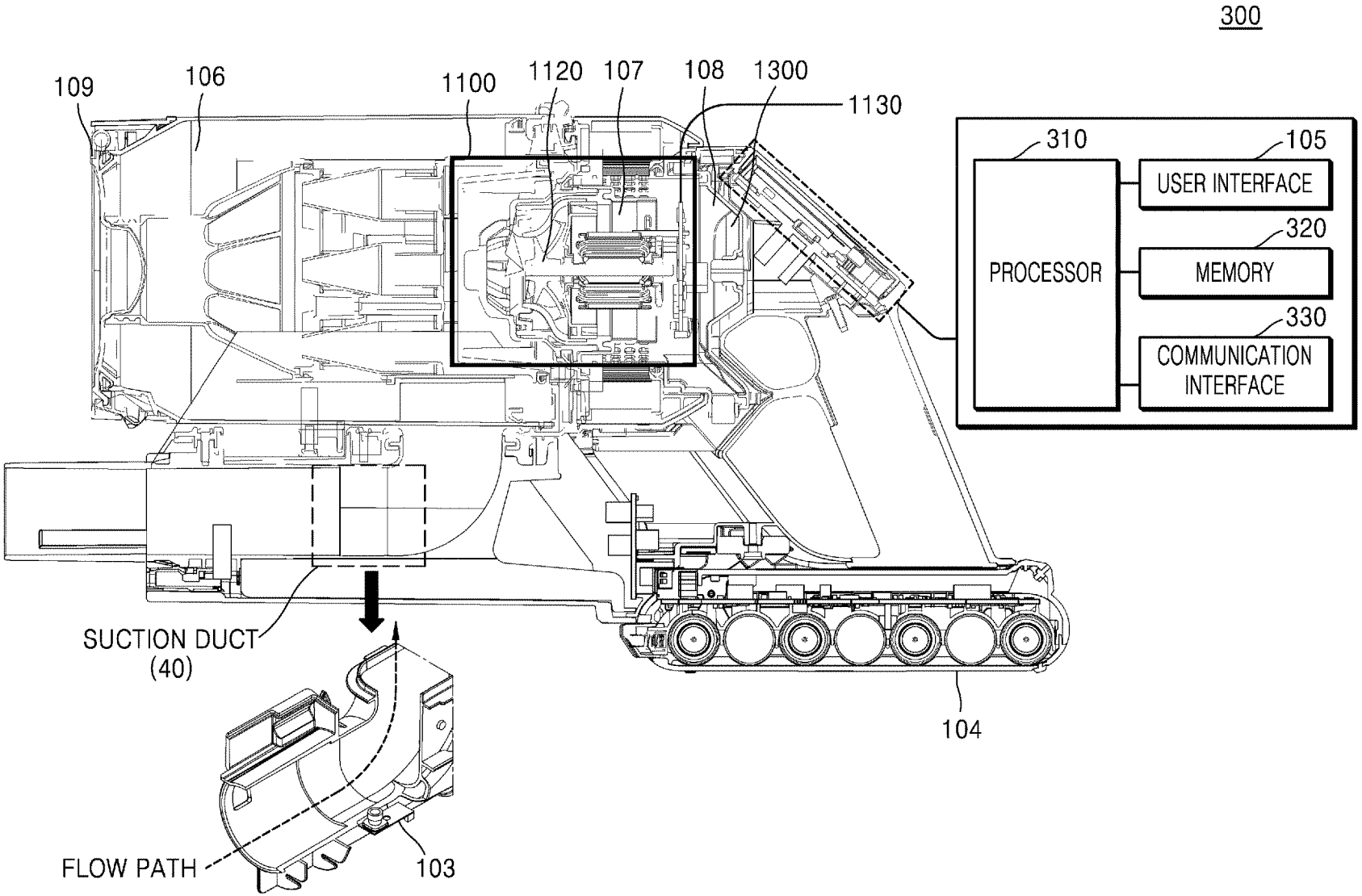
FIG. 3 is a diagram of a cleaner body of a wireless vacuum cleaner, according to an embodiment of the disclosure.

FIG. 3 is a diagram of a cleaner body of a wireless vacuum cleaner according to an embodiment of the disclosure.

Referring to FIG. 3, a cleaner body 300 may include a handle to be grabbed by the user. The cleaner body 300 may also be referred to as a handy body. The user may grab the handle and move the cleaner body 300 and the brush device 101 back and forth or left and right.

The cleaner body 300 may include a suction power generating device (hereinafter, referred to as a motor assembly 1100) generating suction power required to suck up foreign materials on the surface to be cleaned. In addition, the cleaner body 300 may include the first dust collection part 106 (also referred to as a dust container) in which foreign materials sucked up from the surface to be cleaned are accommodated, the filter portion 1300, the sensor 103, the battery 104 capable of supplying power to the motor assembly 1100, the user interface 105, the processor 310, memory 320, and the communication interface 330.

The motor assembly 1100 shown in FIG. 3 may include the first suction motor 107 configured to switch electric force to mechanical rotating force, a fan 1120 rotating by being connected to the first suction motor 107, and a printed circuit board (PCB) 1130 connected to the first suction motor 107.

The first suction motor 107 may provide a vacuum inside the wireless vacuum cleaner 100. Here, the vacuum denotes a state lower than the atmospheric pressure. The first suction motor 107 may include a brushless direct current (BLDC) motor, but is not limited thereto.

The PCB 1130 may control operations of the first suction motor 107. The PCB 1130 may be configured to control communication with the brush device 101. The PCB 1130 may be configured to detect a load of the brush device 101, but is not limited thereto. The PCB 1130 may include a processor to perform the above-described operations. When the PCB 1130 includes the processor, the processor included in the PCB 1130 may be controlled by the processor 310.

The PCB 1130 may obtain data (hereinafter, referred to as state data) related to a state of the first suction motor 107, and transmit the state data of the first suction motor 107 to the processor 310. In addition, the PCB 1130 may transmit a control signal for controlling the brush device 101 to the brush device 101. For example, the control signal transmitted to the brush device 101 may include data indicating at least one of target revolutions per minute (RPM) of a motor included in the brush device 101 (or target RPM of a drum), a target trip level of the motor included in the brush device 101, or power consumption of the first suction motor 107, but is not limited thereto.

The PCB 1130 may detect a signal transmitted from the brush device 101. Data indicating a current state of the brush device 101 may be transmitted, but an embodiment of the disclosure is not limited thereto. For example, the brush device 101 may transmit data related to a condition being currently operated (e.g., RPM of the motor, a current trip level, or the like) to the PCB 1130. In addition, the brush device 101 may transmit data indicating a type of the brush device 101 to the PCB 1130. The PCB 1130 may transmit, to the processor 310, the data indicating the current state of the brush device 101 or the data indicating the type of the brush device 101.

The motor assembly 1100 may be located in the first dust collection part 106. The first dust collection part 106 may be configured to filter out dust or dirt in the air introduced through the brush device 101, and collect the same. The first dust collection part 106 may be provided to be attached to or detached from the cleaner body 300.

The first dust collection part 106 may collect foreign materials through a cyclone scheme of separating the foreign materials by using centrifugal force. The air from which the foreign materials are removed through the cyclone scheme may be discharged out of the cleaner body 300, and the foreign materials may be contained in the first dust collection part 106. A multi-cyclone may be arranged inside the first dust collection part 106. The first dust collection part 106 may be provided such that the foreign materials are collected below the multi-cyclone. The first dust collection part 106 may include the dust discharge cover 109 for opening the first dust collection part 106 such that the wireless vacuum cleaner 100 is connected to the station device 200 when docked to the station device 200. The dust discharge cover 109 may also be referred to as a door that is opened when dust is discharged.

The first dust collection part 106 may include a dust collection part where dust is primarily collected and relatively large foreign materials are collected, and a dust collection part where dust is collected by the multi-cyclone and relatively small foreign materials are collected. The plurality of dust collection parts may all be provided such that, when the dust discharge cover 109 is opened, the collected dust is discharged to the second dust collection part 205 of the station device 200.

The filter portion 1300 may filter out fine particulate matters and the like, which are not filtered out by the first dust collection part 106. The filter portion 1300 may include the exhaust port 108 for discharging the air that passed through a filter to the outside of the wireless vacuum cleaner 100. The filter portion 1300 may include a motor filter or a high-efficiency particulate air (HEPA) filter, but is not limited thereto. The filter portion 1300 may also be referred to as a pre filter or a pre motor filter.

As described above with reference to FIG. 1, the sensor 103 may be configured as a pressure sensor capable of measuring (or detecting) a pressure value of the first suction flow path 110-1 of the wireless vacuum cleaner 100 or a pressure value of the second suction flow path 110-1, 110-2 between the wireless vacuum cleaner 100 and the station device 200. The sensor 103 provided at a suction end (e.g., the suction duct 40) may measure a flow rate change at a corresponding location by measuring static pressure. The sensor 103 may be an absolute pressure sensor or a relative pressure sensor.

The suction duct 40 may be a structure that connects the first dust collection part 106 and the pipe 102 to each other or the first dust collection part 106 and the brush device 101 to each other such that a fluid including the foreign materials may move to the first dust collection part 106. Considering contamination of dirt/dust, the sensor 103 may be located at an end of a straight portion (or an inflection point of the straight portion and a curved portion) of the suction duct 40, but is not limited thereto. The sensor 103 may be located at a center of the straight portion of the suction duct 40. When the sensor 103 is located at the suction duct 40, the sensor 103 may also be referred to as a negative pressure sensor.

In the disclosure, the sensor 103 is located at the suction duct 40, but an embodiment of the disclosure is not limited thereto. The sensor 103 may be located at a discharge end (e.g., inside the motor assembly 1100). When the sensor 103 is located at the motor assembly 1100, the wireless vacuum cleaner 100 according to an embodiment of the disclosure may diagnose blocking of an entire suction flow path of the wireless vacuum cleaner 100, based on a pressure value of the first suction flow path 110-1, measured by using the sensor 103.

The cleaner body 300 may include the communication interface 330 for performing communication with an external device. For example, the cleaner body 300 may communicate with the station device 200, the server device 500, or the user terminal 400, through the communication interface 330.

The communication interface 330 may include a short-range wireless communication interface, a long-range wireless communication interface, and the like. The short-range wireless communication interface may include a Bluetooth communication interface, a BLE communication interface, an NFC interface, a WLAN (Wi-Fi) communication interface, a Zigbee communication interface, an IrDA communication interface, a WFD communication interface, a UWB communication interface, and/or an Ant+ communication interface, but is not limited thereto.

The communication interface 330 may be configured to transmit and receive data to and from the station device 200 through a first communication scheme (e.g., Bluetooth communication) and transmit and receive data to and from the user terminal 400 or the server device (or external device) 500 through a second communication scheme (e.g., Wi-Fi communication).

The user interface 105 may be provided at the handle. The user interface 105 may include an input interface and an output interface. The cleaner body 300 may receive a user input related to an operation of the wireless vacuum cleaner 100 or output information related to an operation of the wireless vacuum cleaner 100, through the user interface 105. The input interface may include a power button, a button for adjusting suction power strength, and the like. The output interface may include an LED display, an LCD, or a touch screen, but is not limited thereto.

The cleaner body 300 may include the processor 310. The processor 310 may include a plurality of processors, and thus, may be referred to as at least one processor. For example, the processor 310 may include a main processor connected to the user interface 105 and a processor connected to the first suction motor 107. The processor connected to the first suction motor 107 may be included in the PCB 1130. When the plurality of processors included in the cleaner body 300 are distributively mounted, the processor 310 may be referred to as a main processor and control another processor (or a sub-processor) included in the cleaner body 300.

The processor 310 may control all operations of the wireless vacuum cleaner 100. For example, the processor 310 may obtain, as a pressure value of the first suction flow path 110-1 of the wireless vacuum cleaner 100, a pressure value measured by the sensor 103 when the wireless vacuum cleaner 100 is docked to the station device 200 and the dust discharge cover 109 is closed. The processor 310 may also detect power consumption of the first suction motor 107, RPM of the motor included in the brush device 101, RPM of the drum included in the brush device 101, a trip level of the brush device 101, and a current value of the motor of the brush device 101.

The processor 310 may obtain, as the first pressure value of the second suction flow path 110-1, 110-2 formed between the wireless vacuum cleaner 100 and the station device 200, a pressure value measured by the sensor 103 when the second suction motor 206 of the station device 200 is operated while there is no dust in the first dust collection part 106 and the second dust collection part 205.

The processor 310 may obtain, as the second pressure value of the second suction flow path 110-1, 110-2 formed between the wireless vacuum cleaner 100 and the station device 200, a pressure value measured by the sensor 103 when the dust discharge operation in which the dust of the first dust collection part 106 is discharged to the second dust collection part 205 is performed.

The processor 310 may detect a ratio between the first pressure value and the second pressure value. The processor 310 may detect a difference (a pressure change rate) between the first pressure value and the second pressure value. The processor 310 may determine a state of the second dust collection part 205 of the station device 200 by comparing the detected ratio with a pre-set threshold value. The pre-set threshold value may include the first threshold value (e.g., 60%), the second threshold value (e.g., 40%), and the third threshold value (e.g., 20%) described with reference to FIG. 1, but is not limited thereto. The processor 310 may determine the state of the second dust collection part 205 by performing, as described above with reference to FIG. 1, comparison between the detected ratio with the pre-set first threshold value, second threshold value, and third threshold value. The processor 310 may determine the state of the second dust collection part 205 included in the station device 200 as described below with reference to FIG. 4.

The processor 310 may determine the state of the second dust collection part 205, based on the difference between the first pressure value and the second pressure value. For example, the processor 310 may determine that a dust amount of the second dust collection part 205 is large when the difference between the first pressure value and the second pressure value is high. For example, the processor 310 may determine that the dust amount of the second dust collection part 205 is small when the difference between the first pressure value and the second pressure value is low.

The processor 310 according to an embodiment of the disclosure may include at least one circuitry, such as a CPU, a GPU, an APU, an MIC, a DSP, or an NPU. The processor 310 may be implemented in the form of an integrated SoC including one or more electronic components. When the processor 310 is configured as a plurality of processors, the plurality of processors may be realized as separate pieces of H/W. The processor 310 may be referred to as a MICOM, an MPU, or an MCU.

The processor 310 according to an embodiment of the disclosure may be implemented as a single core processor or a multicore processor.

Figure 4:
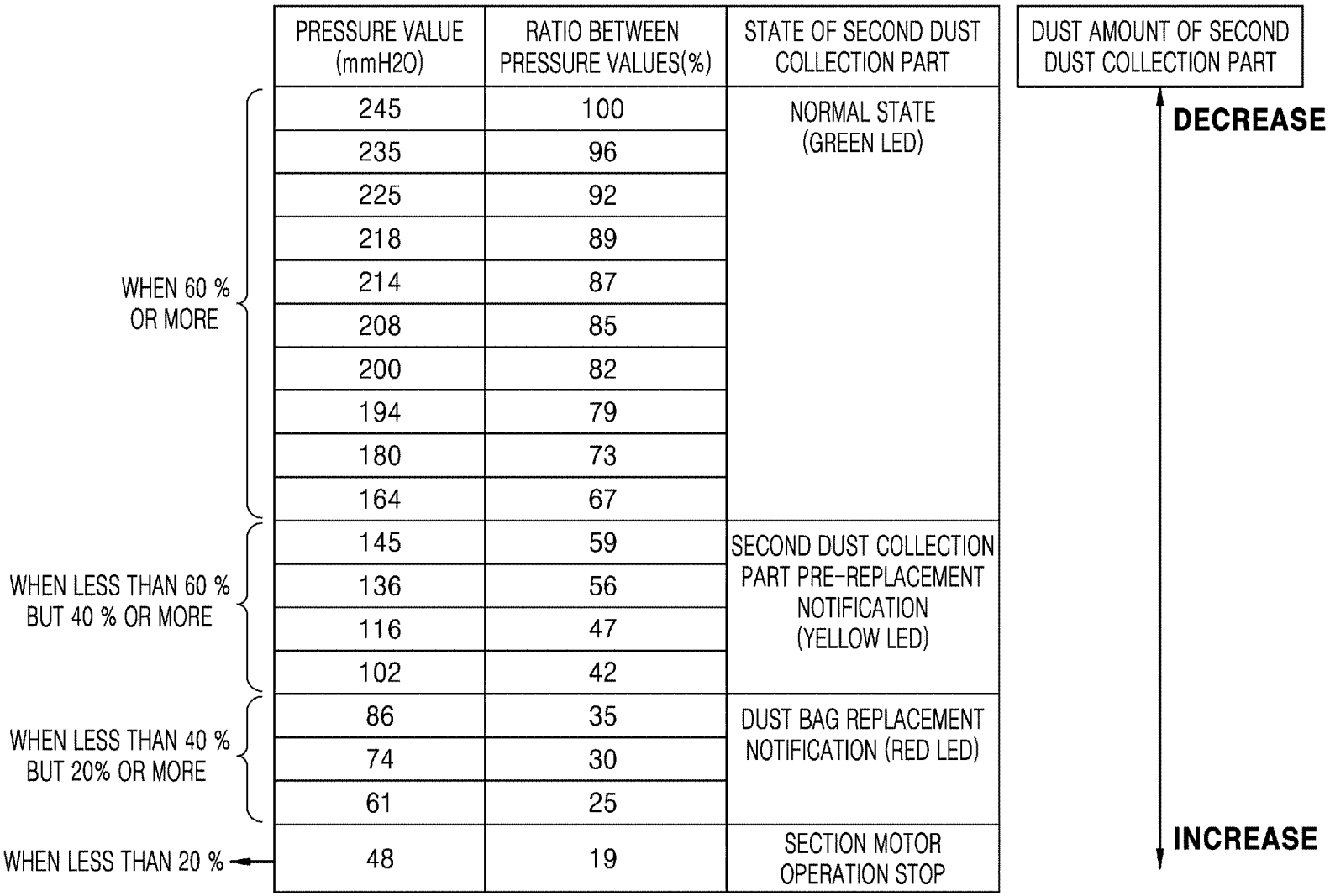
FIG. 4 illustrates a table of relationships between a pressure value measured by a sensor related to a dust discharge operation, a ratio between pressure values, a state of a second dust collection part, pre-set threshold values, and a dust amount of the second dust collection part, according to an embodiment of the disclosure.

FIG. 4 illustrates a table of relationships between a pressure value measured by a sensor when a dust discharge operation is performed, a ratio (%)between pressure values, pre-set threshold values, a state of a second dust collection part, and a dust amount of a second dust collection part, according to an embodiment of the disclosure.

Referring to FIG. 4, when the first pressure value of the second suction flow path 110-1, 110-2 formed between the wireless vacuum cleaner 100 and the station device 200, measured by the sensor 103 when the second suction motor 206 of the station device 200 is operated while there is no dust in the first dust collection part 106 and the second dust collection part 205 is 245 mmH2O, and the second pressure value measured by the sensor 103 when the dust discharge operation is performed is 194 mmH2O, the processor 310 may detect the pressure ratio as 79%. Because the detected pressure ratio is the pre-set first threshold value (e.g., 60%) or more, the processor 310 may determine the state of the second dust collection part 205 included in the station device 200 as a normal state. The processor 310 may detect the pressure ratio according to (second pressure value/first pressure value)×100%.

When the second pressure value of the second suction flow path 110-1, 110-2 formed between the wireless vacuum cleaner 100 and the station device 200, measured by the sensor 103, is 145 mmH2O, the processor 310 may detect the pressure ratio as 59%. Accordingly, the detected pressure ratio is less than the pre-set first threshold value (60%) but is the second threshold value (40%) or more, the second threshold value being less than the first threshold value (60%), and thus, the processor 310 may determine the state of the second dust collection part 205 included in the station device 200 as a pre-replacement notification state.

When the second pressure value of the second suction flow path 110-1, 110-2 formed between the wireless vacuum cleaner 100 and the station device 200, measured by the sensor 103, is 74 mmH2O, the processor 310 may detect the pressure ratio as 30%. Accordingly, the detected pressure ratio is less than the pre-set second threshold value (40%) but is the third threshold value (20%) or more, the third threshold value being less than the second threshold value (20%), and thus, the processor 310 may determine the state of the second dust collection part 205 of the station device 200 as a replacement notification state.

When the second pressure value of the second suction flow path 110-1, 110-2 formed between the wireless vacuum cleaner 100 and the station device 200, measured by the sensor 103, is 48 mmH2O, the processor 310 may detect the pressure ratio as 19%. Accordingly, the detected pressure ratio is less than the pre-set third threshold value (20%), and thus, the processor 310 may determine the state of the second dust collection part 205 of the station device 200 as a state in which an operation of the second suction motor 206 needs to be stopped. The first threshold value (60%), the second threshold value (40%), and the third threshold value (20%) are stored in the memory 320, and may be read and used by the processor 310.

As shown in FIG. 4, the processor 310 may determine that a dust amount of the second dust collection part 205 of the station device 200 is decreased when the ratio between the first pressure value and the second pressure value is increased, and the dust amount of the second dust collection part 205 of the station device 200 is increased when the ratio between the first pressure value and the second pressure value is decreased.

Figure 17:
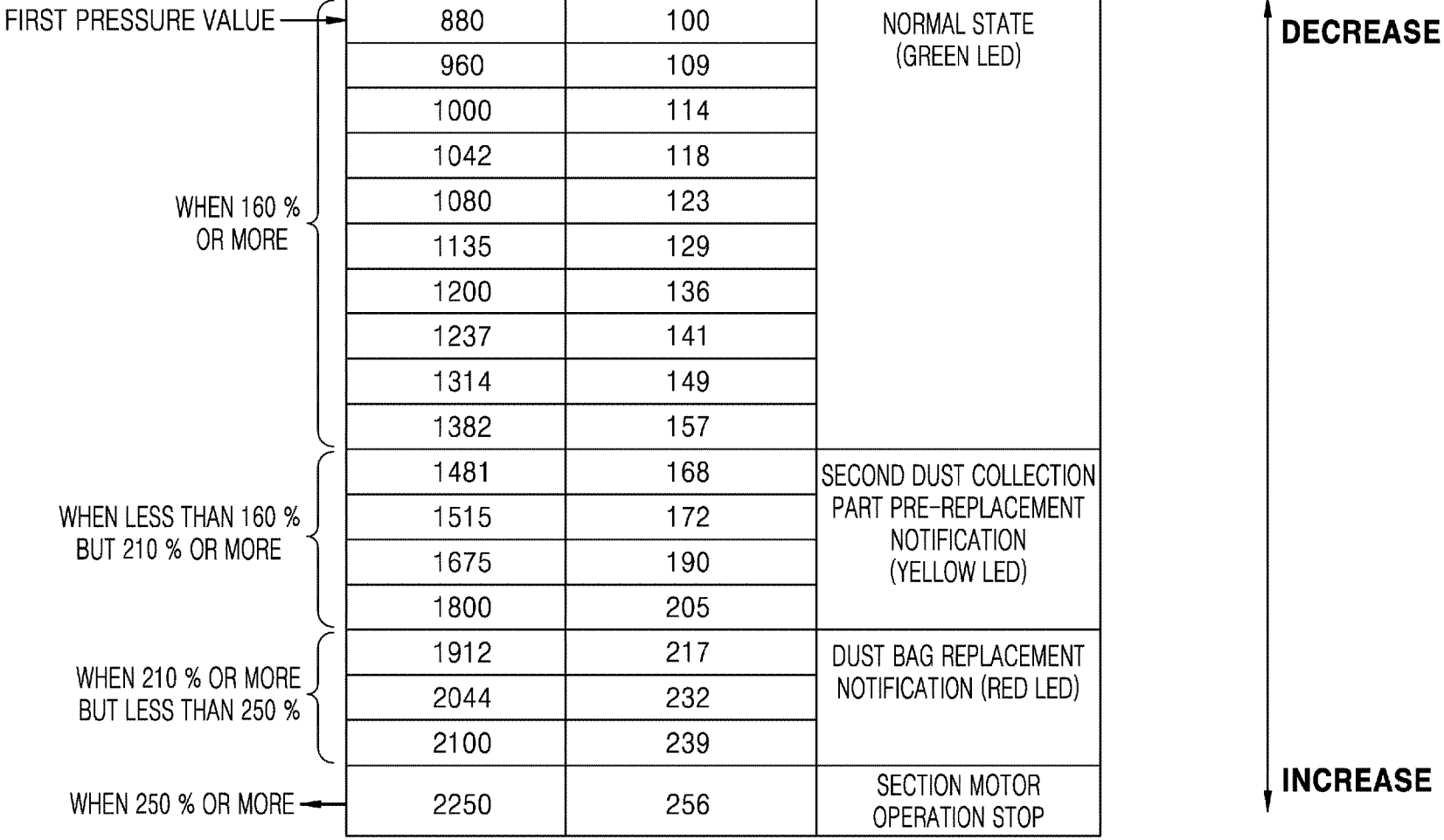
FIG. 17 is a table of a relationship between a pressure value measured by a second sensor mounted on a station device related to a dust discharge operation, a ratio between pressure values, pre-set threshold values, a state of a second dust collection part, and a dust amount of the second dust collection part, according to an embodiment of the disclosure.

In a case where the sensor 103 is mounted on a portion of a suction flow path of the station device 200, when the dust amount in the second dust collection part 205 is increased, the pressure value of the second suction flow path 110-1, 110-2 between the wireless vacuum cleaner 100 and the station device 200 may be increased and the pressure ratio may be increased as shown in FIG. 17 that will be described below, while the dust discharge operation is performed. The suction flow path of the station device 200 may include the suction flow path 110-2 from the exhaust port 108 of the wireless vacuum cleaner 100 to the exhaust port 207 of the station device 200 or a suction flow path including the second dust collection part 205, the second suction motor 206, and the exhaust port 207 of the station device 200. As such, a relationship between pressure of the second suction flow path 110-1, 110-2 based on the station device 200 and pressure of the second suction flow path 110-1, 110-2 based on the wireless vacuum cleaner 100 has a correlation close to 1 as shown in FIG. 5.

Figure 5:
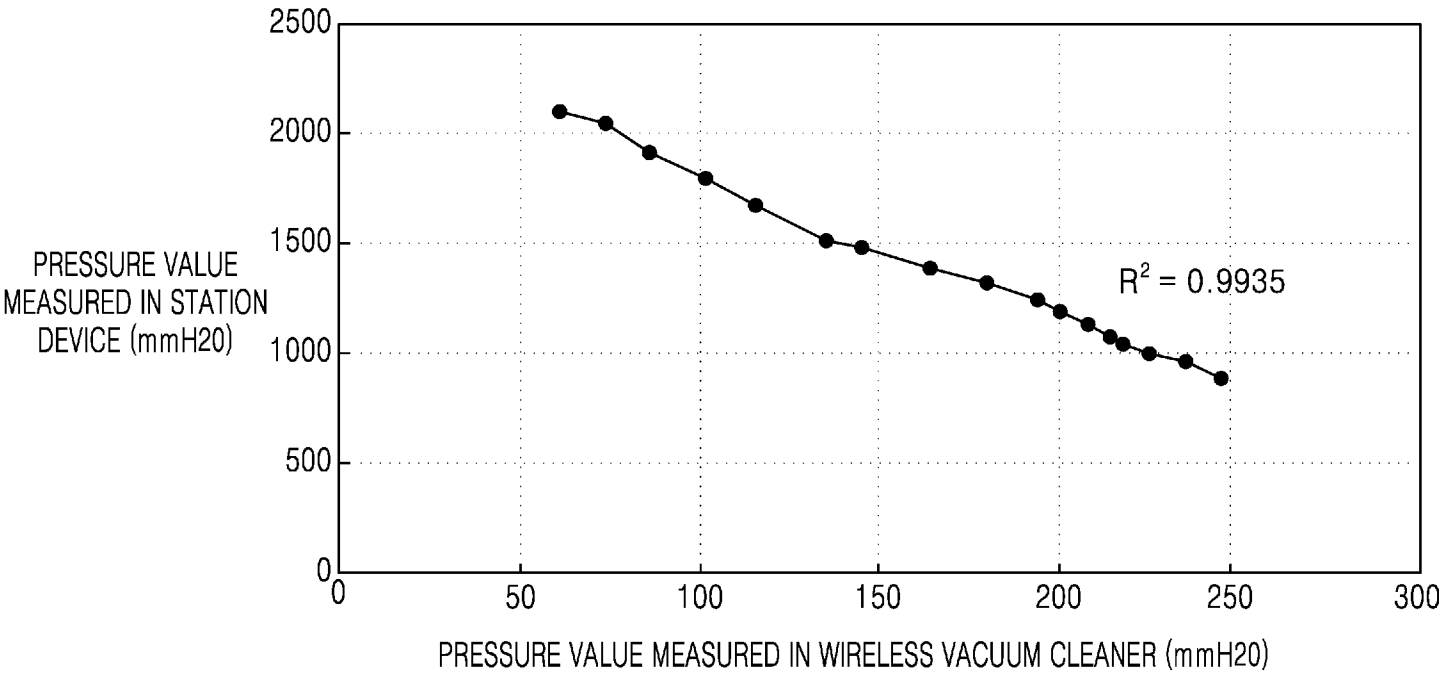
FIG. 5 is a graph of a relationship between a pressure value measured by a wireless vacuum cleaner related to a dust discharge operation and a pressure value measured by a station device, according to an embodiment of the disclosure.

FIG. 5 is a graph of a relationship between a pressure value of a second suction flow path measured in a wireless vacuum cleaner and a pressure value of a second suction flow path measured in a station device, when a dust discharge operation is performed, according to an embodiment of the disclosure.

Referring to FIG. 5, when the pressure value measured by the sensor 103 mounted on the wireless vacuum cleaner 100 is increased, the pressure value measured in the station device 200 is decreased, and the pressure value measured by the sensor 103 of the wireless vacuum cleaner 100 is decreased, the pressure value measured in the station device 200 is increased. Accordingly, the pressure value measured by the sensor 103 mounted on the wireless vacuum cleaner 100 being low may indicate that the pressure value measured in the station device 200 is high. Accordingly, the state of the second dust collection part 205 of the station device 200 may be determined by using the pressure value measured by the sensor 103 mounted on the wireless vacuum cleaner 100, without having to mount an additional sensor on the station device 200.

Figure 6:
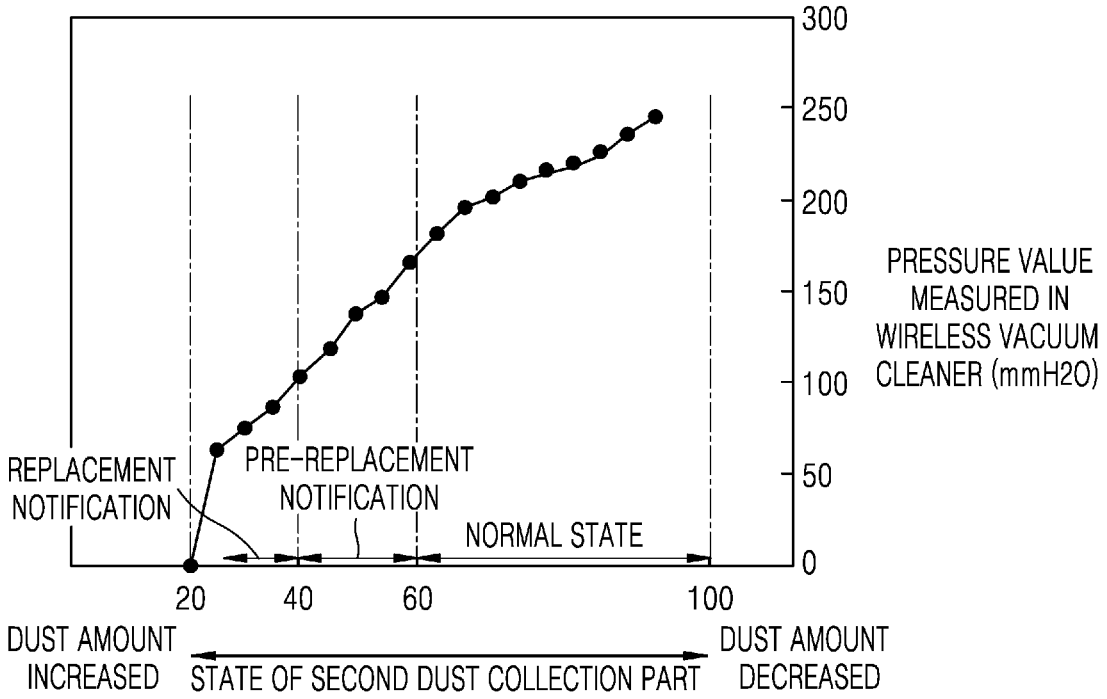
FIG. 6 is a graph of a relationship between a pressure value measured by a wireless vacuum cleaner related to a dust discharge operation and information about a state of a second dust collection part of a station device, according to an embodiment of the disclosure.

FIG. 6 is a graph of a relationship between a pressure value of a second suction flow path between a wireless vacuum cleaner and a station device and information about a state of a second dust collection part included in a station device according to an embodiment of the disclosure.

Referring to FIG. 6, the memory 320 may store a program or at least one instruction for processes and control by the processor 310. The processor 310 may perform an operation according to an embodiment of the disclosure by executing the program or at least one instruction stored in the memory 320.

The memory 320 may store data capable of detecting blocking of the first suction flow path 110-1 of the wireless vacuum cleaner 100. The data capable of detecting the blocking of the first suction flow path 110-1 of the wireless vacuum cleaner 100 may include data about a third pressure value and a fourth pressure value of the first suction flow path 110-1 of the wireless vacuum cleaner 100, obtained by using the pressure value measured by the sensor 103. The third pressure value may be a pressure value of the first suction flow path 110-1, measured by the sensor 103, according to an operation of the first suction motor 107 when there is no dust in the first dust collection part 106 and the dust discharge cover 109 is closed. The fourth pressure value may be a pressure value of the first suction flow path 110-1, measured by the sensor 103, when dust is collected in the first dust collection part 106 according to an operation of the first suction motor 107 and the dust discharge cover 109 is closed. The memory 320 may store data required to perform self-diagnosis of the wireless vacuum cleaner 100, by using a difference between the third pressure value and the fourth pressure value. For example, the data required to perform the self-diagnosis of the wireless vacuum cleaner 100 may include the difference between the third pressure value and the fourth pressure value including 751 Pa, 750 to 401 Pa, and 400 Pa shown in FIG. 7 described below, but is not limited thereto.

The memory 320 may store data for detecting the state of the second dust collection part 205 of the station device 200. For example, the memory 320 may store mapping information between the second dust collection part 205 and information about a pressure ratio (e.g., the ratio between the pressure values shown in the table of FIG. 4) based on the first threshold value (60%), the second threshold value (40%), and the third threshold value (20%).

The memory 320 may store pieces of input/output data (e.g., a pre-trained artificial intelligence (AI) model (support vector machine (SVM) algorithm), state data of the first suction motor 107, a value measured by the sensor 103, state data of the battery 104, state data of the brush device 101, error occurrence data, power consumption of the first suction motor 107 corresponding to an operating condition, RPM of the drum included in the brush device 101, RPM of a motor included in the brush device 101, and a trip level of the motor included in the brush device 101). The trip level is for preventing overload of the brush device 101, and may denote a reference load value (e.g., a reference current value of the motor) for stopping an operation of the brush device 101.

The memory 320 may include at least one type of storage medium among a flash memory type, a hard disk type, a multimedia card micro type, card type memory (for example, secure digital (SD) or extreme digital (XD) memory, or the like), random access memory (RAM), static RAM (SRAM), read-only memory (ROM), electrically erasable programmable ROM (EEPROM), programmable ROM (PROM), magnetic memory, a magnetic disk, and an optical disk. Programs stored in the memory 320 may be classified into a plurality of modules depending on functions.

FIG. 7 illustrates a table related to a self-diagnosis of a wireless vacuum cleaner, based on a pressure value measured by a sensor included in a wireless vacuum cleaner, before a dust discharge operation according to an embodiment of the disclosure is performed.

Referring to FIG. 7, before the dust discharge operation is performed, the processor 310 of the wireless vacuum cleaner 100 may obtain a pressure value measured by the sensor 103 as the third pressure value of the first suction flow path 110-1 of the wireless vacuum cleaner 100, when there is no dust in the first dust collection part 106. The third pressure value may be a pressure value of the first suction flow path 110-1 of the wireless vacuum cleaner 100, measured by the sensor 103, according to an operation of the first suction motor 107 when there is no dust in the first dust collection part 106 and the dust discharge cover 109 is closed. The third pressure value may be referred to as the initial pressure value of the wireless vacuum cleaner 100.

The processor 310 of the wireless vacuum cleaner 100 may obtain a pressure value measured by the sensor 103 while dust is collected in the first dust collection part 106 according to an operation of the first suction motor 107, as the fourth pressure value of the first suction flow path 110-1 of the wireless vacuum cleaner 100. The fourth pressure value may be a pressure value of the first suction flow path 110-1 of the wireless vacuum cleaner 100 while dust is collected in the first dust collection part 106.

The processor 310 may detect a difference between the third pressure value and the fourth pressure value. The processor 310 may diagnose a state of the wireless vacuum cleaner 100 by comparing the detected difference with data stored in the memory 320.

For example, when the detected difference is 751 Pa or more, the processor 310 may first determine that a flow path of the pipe 102 or a flow path of the brush device 101 is blocked, and output a result of the determination as notification information. The notification information may be output through the user interface 105, but is not limited thereto. For example, the notification information may be transmitted to the station device 200 or to an external device, such as the user terminal 400 or the server device 500, through the communication interface 330.

For example, when the detected difference is 751 Pa or more, the processor 310 may output the notification information one time, and then when the detected difference is again detected to be 751 Pa or more, the processor 310 may determine that foreign materials are caught in the brush device 101 and output a result of the determination as the notification information. The notification information may be output through the user interface 105, but is not limited thereto. For example, the notification information may be transmitted to the station device 200 or to an external device, such as the user terminal 400 or the server device 500, through the communication interface 330.

For example, when the detected difference is 751 Pa or more, the processor 310 may output the notification information two times, and then when the detected difference is again detected to be 751 Pa or more, the processor 310 may determine that the filter portion 1300 (or pre motor filter) needs to be cleaned or the first dust collection part 106 needs to be cleaned, and output a result of the determination as the notification information. The notification information may be output through the user interface 105, but is not limited thereto. For example, the notification information may be transmitted to the station device 200 or to an external device, such as the user terminal 400 or the server device 500, through the communication interface 330.

For example, when the detected difference is 751 Pa or more, the processor 310 may output the notification information three times, and then when the detected difference is again detected to be 751 Pa or more, the dust discharge operation may be automatically performed, but an embodiment of the disclosure is not limited thereto. For example, the processor 310 may maintain an operation of outputting the notification information.

For example, when the detected difference is 750 Pa to 401 Pa, the processor 310 may determine that the brush device 101 needs to be inspected and output a result of the determination as the notification information. The notification information may be output through the user interface 105, but is not limited thereto. For example, the notification information may be transmitted to the station device 200 or to an external device, such as the user terminal 400 or the server device 500, through the communication interface 330.

For example, when the detected difference is 750 Pa to 401 Pa, the processor 310 may output the notification information one time, and then when the detected difference is detected to be 750 Pa to 401 Pa again, the processor 310 may maintain an operation of outputting the notification information, but is not limited thereto.

For example, when the detected difference is 400 Pa or less, the processor 310 may first determine that the brush device 101 needs to be inspected and output a result of the determination as the notification information. The notification information may be output through the user interface 105, but is not limited thereto. For example, the notification information may be transmitted to the station device 200 or to an external device, such as the user terminal 400 or the server device 500, through the communication interface 330.

When the detected difference is 400 Pa or less, the processor 310 may output the notification information one time, and then when the detected difference is detected to be 400 Pa or less again, the processor 310 may determine that the filter portion 1300 (or pre motor filter) or the first dust collection part 106 needs to be cleaned, and maintain an operation of outputting a result of the determination as the notification information, but is not limited thereto.

The determination of the processor 310 described with reference to FIG. 7 may be referred to as a self-diagnosis of the wireless vacuum cleaner 100.

Figure 8:
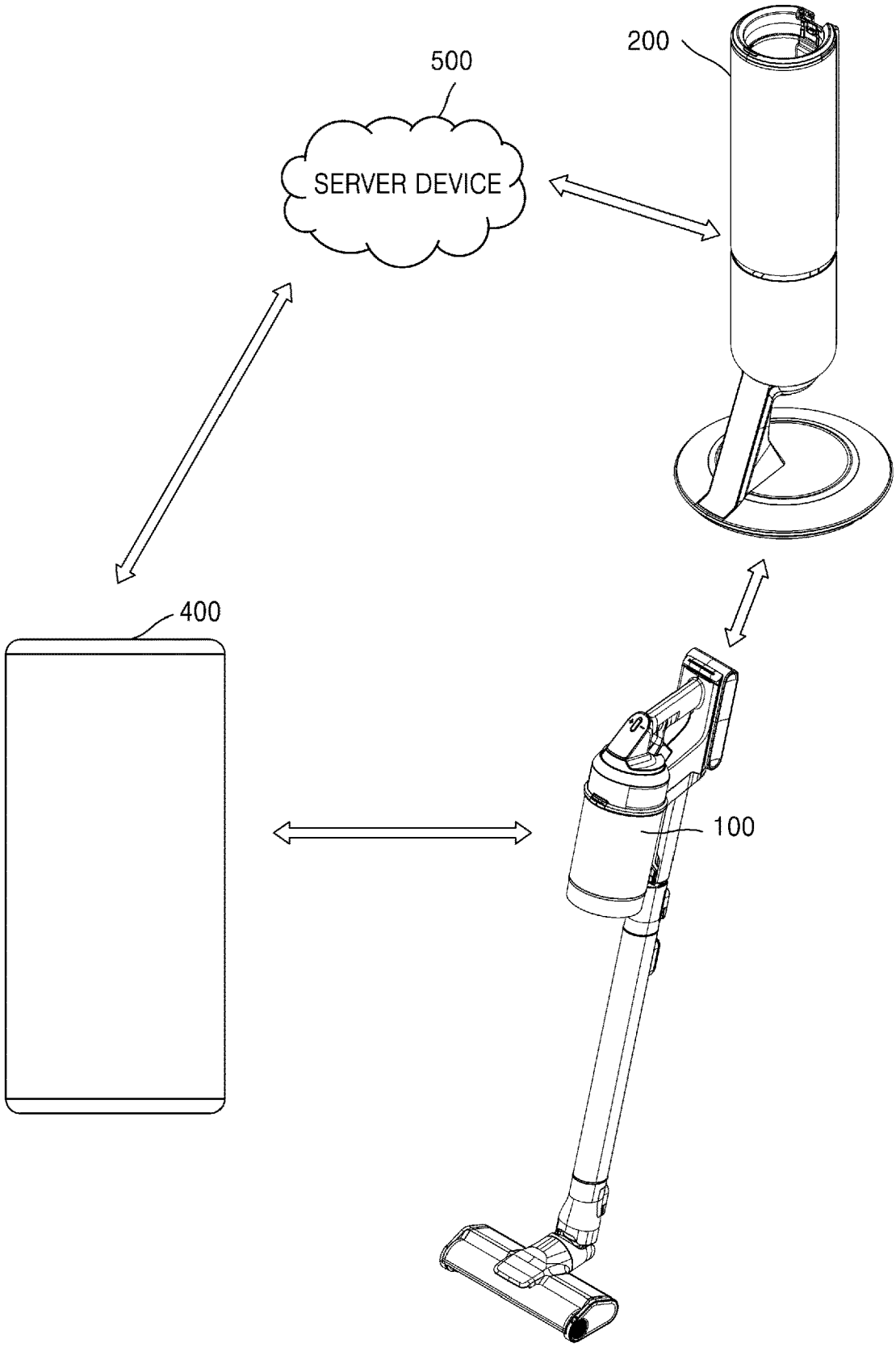
FIG. 8 is a diagram illustrating a vacuum cleaner system according to an embodiment of the disclosure.

FIG. 8 is a diagram illustrating a vacuum cleaner system according to an embodiment of the disclosure.

Referring to FIG. 8, the vacuum cleaner system 1000 according to an embodiment of the disclosure may further include the user terminal 400 and the server device 500, in addition to the wireless vacuum cleaner 100 and the station device 200. The vacuum cleaner system 1000 including the wireless vacuum cleaner 100 and the station device 200 has been described with reference to FIG. 1, and thus the user terminal 400 and the server device 500 will be described hereinafter.

The user terminal 400 according to an embodiment of the disclosure may be a device registered in the server device 500 under a same account as the station device 200 or wireless vacuum cleaner 100. Examples of the user terminal 400 include a smartphone, a laptop computer, a tablet personal computer (PC), a digital camera, an electronic book terminal, a digital broadcasting terminal, a personal digital assistant (PDA), a portable multimedia player (PMP), a wearable device, and a device including a display, but are not limited thereto. Hereinafter, for convenience of descriptions, an example in which the user terminal 400 is a smartphone will be described.

According to an embodiment of the disclosure, the user terminal 400 may communicate with at least one of the server device 500, the station device 200, or the wireless vacuum cleaner 100. The user terminal 400 may directly communicate with the station device 200 or wireless vacuum cleaner 100 through NFC, or indirectly communicate with the station device 200 or wireless vacuum cleaner 100 through the server device 500.

According to an embodiment of the disclosure, the user terminal 400 may execute a specific application (e.g., a home appliance management application) provided by the server device 500, based on a user input. In this case, the user may identify a state of the wireless vacuum cleaner 100 or a state of the station device 200 through an application execution window.

For example, the user terminal 400 may provide, through the application execution window, state information (e.g., a normal state, a pre-replacement notification, a replacement notification, or the like) of the second dust collection part 205 of the station device 200, information (e.g., last dust container emptied—1 minute ago) related to dust discharge of the station device 200, an icon (e.g., dust discharge) related to dust discharge, an icon (e.g., automatic dust discharge) for setting an operating mode related to dust discharge, and the like, but is not limited thereto. According to an embodiment of the disclosure, the user terminal 400 may provide, to the user, a notification related to the state of the wireless vacuum cleaner 100 or the state of the station device 200.

The server device 500 according to an embodiment of the disclosure may be a device for managing the station device 200 and the wireless vacuum cleaner 100. For example, the server device 500 may be a home appliance management server. The server device 500 may manage user account information and information of home appliances connected to a user account. For example, the user may generate the user account by accessing the server device 500 through the user terminal 400. The user account may be identified by an ID and a password set by the user.

The server device 500 may register the station device 200 and the wireless vacuum cleaner 100 to the user account according to a determined procedure. For example, the server device 500 may connect identification information (e.g., a serial number or a medium access control (MAC) address) of the station device 200 and identification information of the wireless vacuum cleaner 100 to the user account to register the station device 200 and the wireless vacuum cleaner 100. When the station device 200 and the wireless vacuum cleaner 100 are registered in the server device 500, the server device 500 may periodically receive state information of the station device 200 or state information of the wireless vacuum cleaner 100 from the station device 200 to manage the state of the station device 200 or the state of the wireless vacuum cleaner 100. The state information of the station device 200 may include state information (e.g., a normal state, a pre-replacement notification state, a replacement notification state, or the like) of the second dust collection part 205 included in the station device 200. The state information of the wireless vacuum cleaner 100 may include flow path blocked location information of the wireless vacuum cleaner 100 and state information (e.g., a normal state, a state in need of dust discharge, or the like) of the first dust collection part 106.

Figure 9:
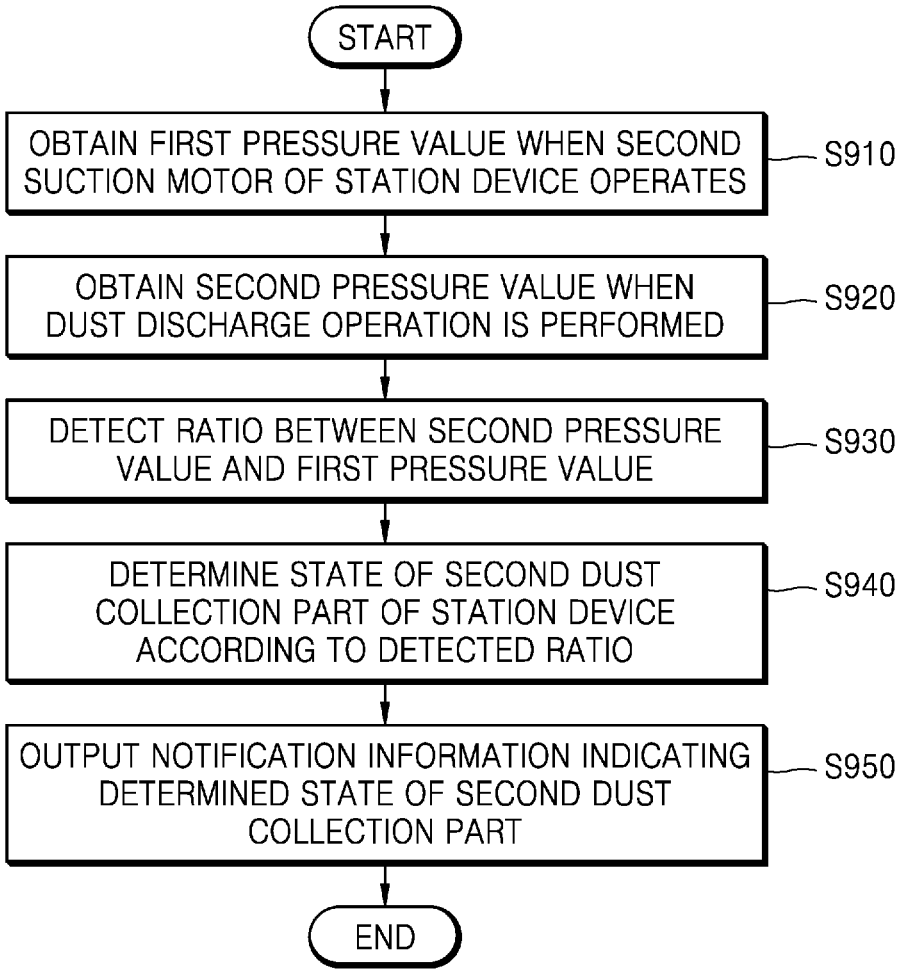
FIG. 9 is a flowchart of an operating method of a wireless vacuum cleaner, according to an embodiment of the disclosure.

FIG. 9 is a flowchart of an operating method of a wireless vacuum cleaner, according to an embodiment of the disclosure. The operating method of FIG. 9 may be performed by the processor 310 of the wireless vacuum cleaner 100.

Referring to FIG. 9, in operation S910, the processor 310 may obtain, as the first pressure value, a pressure value measured by the sensor 103 when the second suction motor 206 of the station device 200 operates while there is no dust in the first dust collection part 106 and the second dust collection part 205. The first pressure value may be defined as the initial pressure value of the second suction flow path 110-1, 110-2 formed between the wireless vacuum cleaner 100 and the station device 200 when the dust discharge cover 109 is opened.

In operation S920, the processor 310 may obtain, as the second pressure value, a pressure value measured by the sensor 103 when the dust discharge operation in which dust of the first dust collection part 106 is discharged to the second dust collection part 205 is performed. The second pressure value may be defined as a pressure value of the second suction flow path 110-1, 110-2 between the wireless vacuum cleaner 100 and the station device 200 while dust is collected in the second dust collection part 205 as the dust discharge operation is performed. Here, suction power may be generated according to an operation of the second suction motor 206. The second pressure value may be obtained from at least one of the dust discharge operation duration, the duration before the dust discharge operation is ended, or the stable duration of the dust discharge operation.

In operation S930, the processor 310 of the wireless vacuum cleaner 100 may detect a ratio between the first pressure value and the second pressure value. The processor 310 may detect the ratio according to (second pressure value/first pressure value)×100%.

In operation S940, the processor 310 of the wireless vacuum cleaner 100 may determine a state of the second dust collection part 205 of the station device 200 according to the detected pressure ratio. For example, when the detected pressure ratio is the first threshold value (e.g., 60%) or more, the processor 310 may determine a state of the second dust collection part 205 as a normal state. For example, when the detected pressure ratio is less than the first threshold value (e.g., 60%) but the second threshold value (e.g., 40%) or more, the second threshold value being less than the first threshold value, the processor 310 may determine a state of the second dust collection part 205 as a pre-replacement notification state. For example, when the detected pressure ratio is less than the second threshold value (e.g., 40%) but the third threshold value (e.g., 20%) or more, the third threshold value being less than the second threshold value, the processor 310 may determine a state of the second dust collection part 205 as a replacement notification state. For example, when the detected pressure ratio is less than the third threshold value, the processor 310 may determine a state of the second dust collection part 205 as a state in which an operation of the second dust motor 206 needs to be stopped. As such, when the pressure ratio is low, the processor 310 may determine that a dust amount of the second dust collection part 205 is large (or increase), and when the pressure ratio is high, the processor 310 may determine that the dust amount of the second dust collection part 205 is small (or decrease).

In operation S950, the processor 310 of the wireless vacuum cleaner 100 may output notification information indicating the determined state of the second dust collection part 205. The processor 310 may output the notification information indicating the state of the second dust collection part 205 through the user interface 105. The processor 310 may transmit the notification information indicating the state of the second dust collection part 205 to the station device 200 through the communication interface 330. The processor 310 may output the notification information indicating the state of the second dust collection part 205 to an external device, such as the user terminal 400 or the server device 500, through the communication interface 330. The notification information may be output in the form of a message. The notification information may be output in the form of an icon (or an identifier). The notification information may be output in the form of voice or sound. The processor 310 may simultaneously output the notification information in the forms of a message and voice or sound. The processor 310 may output or transmit the notification information simultaneously to the wireless vacuum cleaner 100, the station device 200, the user terminal 400, and the server device 500. When the notification information is simultaneously transmitted to the station device 200, the user terminal 400, and the server device 500, the communication interface 330 may transmit the notification information by using communication channels established independently for the station device 200, the user terminal 400, and the server device 500, respectively. The communication interface 330 may transmit the notification information to the station device 200, the user terminal 400, and the server device 500 by using different communication schemes (e.g., a Bluetooth scheme, a Wi-Fi scheme, a wired communication scheme, and the like).

The method of FIG. 9 is implemented based on the ratio between the first pressure value and the second pressure value, but the processor 310 may be configured to determine a state of the second dust collection part 205, based on a pressure change rate that is a difference between the first pressure value and the second pressure value. In this case, the processor 310 may determine that the dust amount of the second dust collection part 205 is large when the pressure change rate is high and determine that the dust amount of the second dust collection part 205 is small when the pressure change rate is low.

Figure 10:
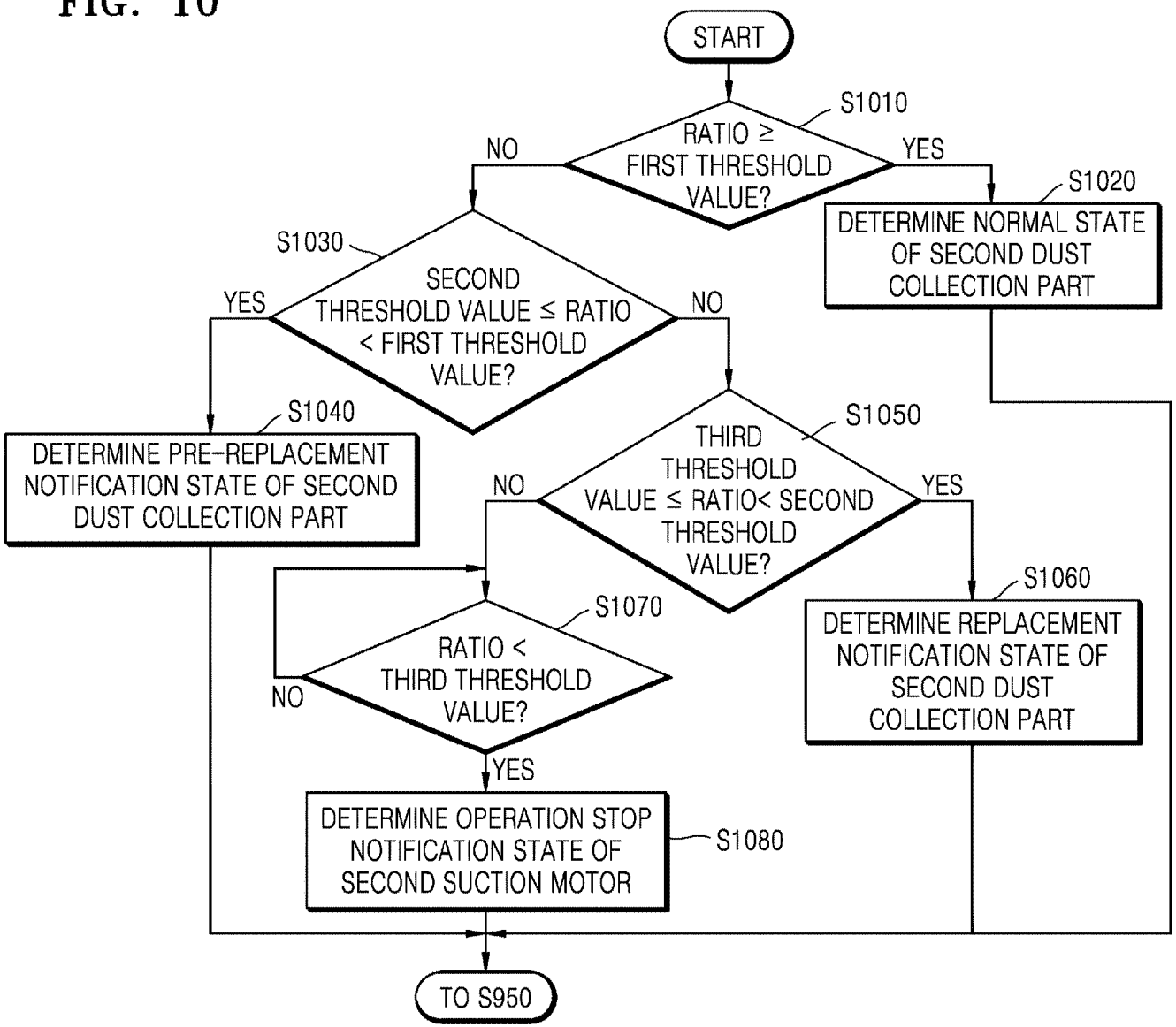
FIG. 10 is a flowchart of a process of determining a state of a second dust collection part, among an operating method of a wireless vacuum cleaner, according to an embodiment of the disclosure.

FIG. 10 is a flowchart of a process of determining a state of a second dust collection part, among an operating method of a wireless vacuum cleaner, according to an embodiment of the disclosure. The operating method of FIG. 10 may be performed by the processor 310 of the wireless vacuum cleaner 100.

Referring to FIG. 10, in operation S1010, the processor 310 determines whether the detected pressure ratio is the first threshold value (e.g., 60%) or more. When the pressure ratio is the first threshold value or more as a result of the determination in operation S1010, the processor 310 may determine a state of the second dust collection part 205 as a normal state in operation S1020.

When it is determined that the pressure ratio is not the first threshold value or more in operation S1010, the processor 310 determines whether the pressure ratio is less than the first threshold value (e.g., 60%) but is the second threshold value (e.g., 40%) or more, the second threshold value being less than the first threshold value, in operation S1030. When it is determined that the pressure ratio is less than the first threshold value (e.g., 60%) but is the second threshold value (e.g., 40%) or more in operation S1030, the processor 310 may determine a pre-replacement notification state of the second dust collection part 205 in operation S1040.

When it is determined that the pressure ratio is less than the first threshold value (e.g., 60%) but is not the second threshold value (e.g., 40%) or more in operation S1030, the processor 310 determines whether the pressure ratio is less than the second threshold value (e.g., 40%) but is the third threshold value (e.g., 20%) or more, the third threshold value being less than the second threshold value, in operation S1050.

When it is determined that the pressure ratio is less than the second threshold value (e.g., 40%) but is the third threshold value (e.g., 20%) or more in operation S1050, the processor 310 may determine a replacement notification state of the second dust collection part 205 in operation S1060.

When it is determined that the pressure ratio is less than the second threshold value (e.g., 40%) but is not the third threshold value (e.g., 20%) or more in operation S1050, the processor 310 determines whether the pressure ratio is less than the third threshold value (e.g., 20%) in operation S1070.

When it is determined that the pressure ratio is less than the third threshold value (e.g., 20%) in operation S1070, the processor 310 may determine that a state of the second dust collection part 205 is in a notification state (or an operation stop notification state) in which an operation of the second suction motor 206 needs to be stopped, in operation S1080.

When the operation stop notification state of the second suction motor 206 is determined, the processor 310 may output notification information indicating the operation stop notification state of the second suction motor 206 in operation S950, and then transmit a control signal for stopping the operation of the second suction motor 206 to the station device 200 through the communication interface 330 so as to stop the operation of the second suction motor 206 of the station device 200. Accordingly, the second suction motor 206 may be prevented from being damaged by a contaminated state of the second dust collection part 205.

Figure 11:
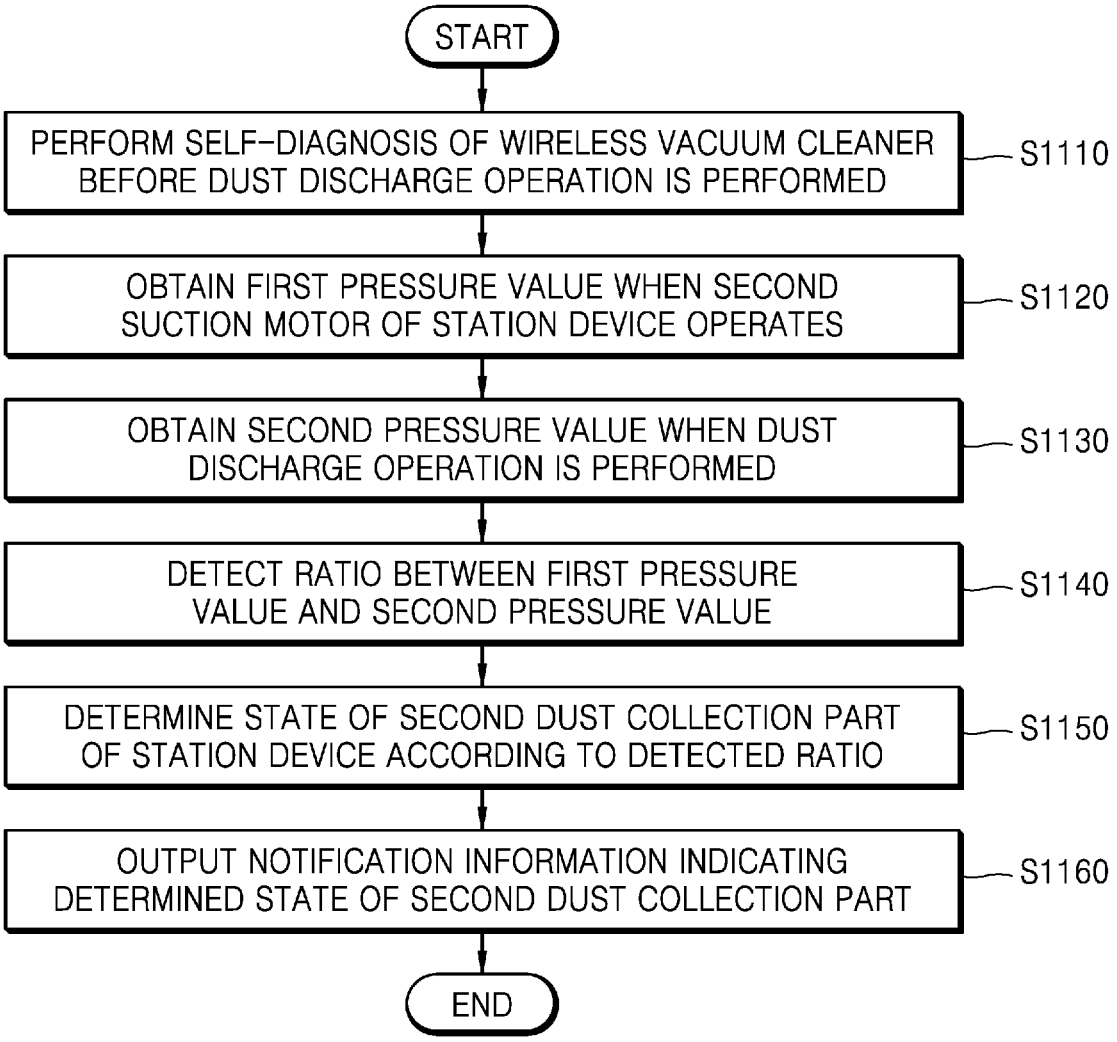
FIG. 11 is a flowchart of an operating method of a wireless vacuum cleaner according to an embodiment of the disclosure.

FIG. 11 is a flowchart of an operating method of a wireless vacuum cleaner according to an embodiment of the disclosure.

Referring to FIG. 11, in operation S1110, the processor 310 of the wireless vacuum cleaner 100 may perform a self-diagnosis of the wireless vacuum cleaner 100 before the dust discharge operation is performed. The self-diagnosis of the wireless vacuum cleaner 100 will be described below with reference to FIG. 12.

In operation S1120, the processor 310 may obtain, as the first pressure value, a pressure value measured by the sensor 103 when the second suction motor 206 of the station device 200 operates while there is no dust in the first dust collection part 106 and the second dust collection part 205. The first pressure value may be defined as the initial pressure value of the second suction flow path 110-1, 110-2 formed between the wireless vacuum cleaner 100 and the station device 200 when the dust discharge cover 109 is opened.

In operation S1130, the processor 310 may obtain, as the second pressure value, a pressure value measured by the sensor 103 when the dust discharge operation in which dust of the first dust collection part 106 is discharged to the second dust collection part 205 is performed. The second pressure value may be defined as a pressure value of the second suction flow path 110-1, 110-2 between the wireless vacuum cleaner 100 and the station device 200 while dust is collected in the second dust collection part 205 as the dust discharge operation is performed. Here, suction power may be generated according to an operation of the second suction motor 206. The second pressure value may be obtained from at least one of the dust discharge operation duration, the duration before the dust discharge operation is ended, or the stable duration of the dust discharge operation.

In operation S1140, the processor 310 of the wireless vacuum cleaner 100 may detect the ratio between the first pressure value and the second pressure value. The processor 310 may detect the ratio according to (second pressure value/first pressure value)×100%.

In operation S1150, the processor 310 of the wireless vacuum cleaner 100 may determine a state of the second dust collection part 205 of the station device 200 according to the detected pressure ratio. For example, when the detected pressure ratio is the first threshold value (e.g., 60%) or more, the processor 310 may determine a state of the second dust collection part 205 as the normal state. For example, when the detected pressure ratio is less than the first threshold value (e.g., 60%) but the second threshold value (e.g., 40%) or more, the second threshold value being less than the first threshold value, the processor 310 may determine a state of the second dust collection part 205 as the pre-replacement notification state. For example, when the detected pressure ratio is less than the second threshold value (e.g., 40%) but the third threshold value (e.g., 20%) or more, the third threshold value being less than the second threshold value, the processor 310 may determine a state of the second dust collection part 205 as the replacement notification state. For example, when the detected pressure ratio is less than the third threshold value, the processor 310 may determine a state of the second dust collection part 205 as the state in which an operation of the second suction motor 206 needs to be stopped. As such, when the pressure ratio is low, the processor 310 may determine that a dust amount of the second dust collection part 205 is large (or increase), and when the pressure ratio is high, the processor 310 may determine that the dust amount of the second dust collection part 205 is small (or decrease).

In operation S1160, the processor 310 of the wireless vacuum cleaner 100 may output notification information indicating the determined state of the second dust collection part 205. The processor 310 may output the notification information indicating the state of the second dust collection part 205 through the user interface 105. The processor 310 may transmit the notification information indicating the state of the second dust collection part 205 to the station device 200 through the communication interface 330. The processor 310 may output the notification information indicating the state of the second dust collection part 205 to an external device, such as the user terminal 400 or the server device 500, through the communication interface 330. The notification information may be output in the form of a message. The notification information may be output in the form of an icon (or an identifier). The notification information may be output in the form of voice or sound. The processor 310 may simultaneously output the notification information in the forms of a message and voice or sound. The processor 310 may output or transmit the notification information simultaneously to the wireless vacuum cleaner 100, the station device 200, the user terminal 400, and the server device 500. When the notification information is simultaneously transmitted to the station device 200, the user terminal 400, and the server device 500, the communication interface 330 may transmit the notification information by using communication channels established independently for the station device 200, the user terminal 400, and the server device 500, respectively. The communication interface 330 may transmit the notification information to the station device 200, the user terminal 400, and the server device 500 by using different communication schemes (e.g., a Bluetooth scheme, a Wi-Fi scheme, a wired communication scheme, and the like).

The method of FIG. 11 is implemented based on the ratio between the first pressure value and the second pressure value, but the processor 310 may be configured to determine a state of the second dust collection part 205, based on the pressure rate (or a pressure change rate) that is a difference between the first pressure value and the second pressure value. In this case, the processor 310 may determine that the dust amount of the second dust collection part 205 is large when the pressure rate is high, and the processor 310 may determine that the dust amount of the second dust collection part 205 is small when the pressure rate is low.

Figure 12:
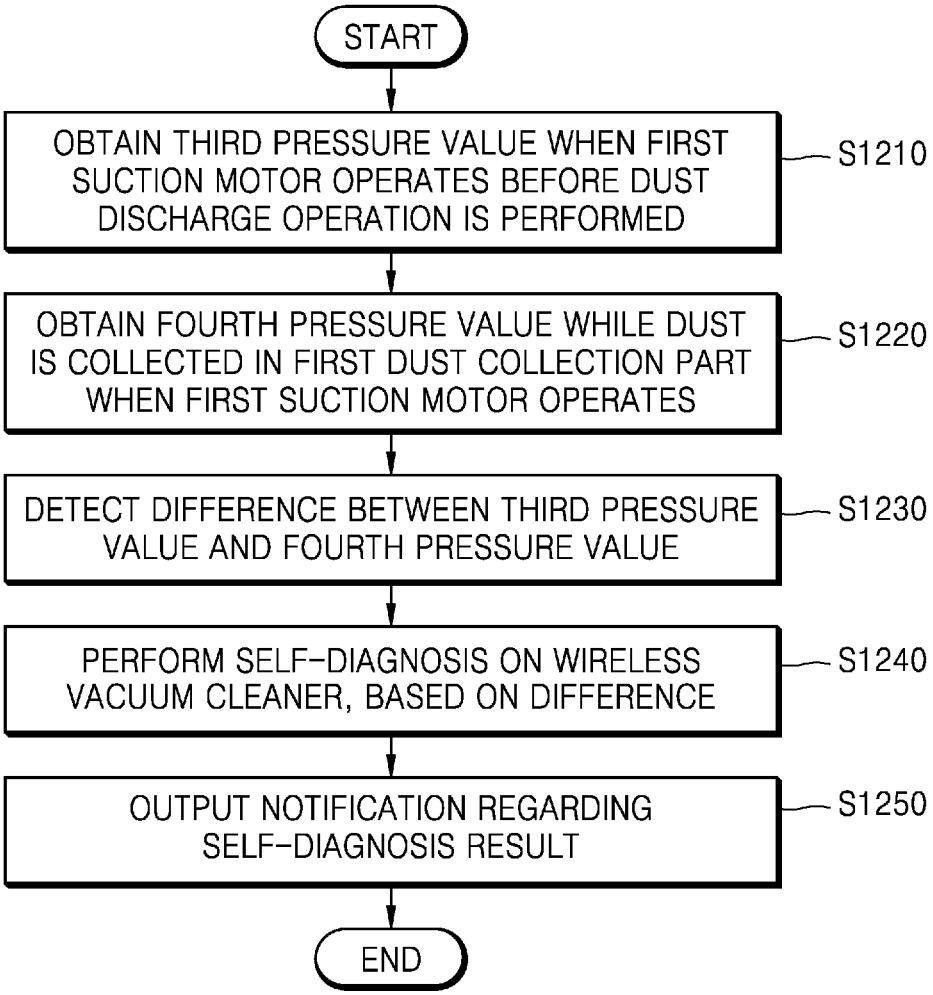
FIG. 12 is a flowchart of a self-diagnosis process of a wireless vacuum cleaner, among an operating method of a wireless vacuum cleaner, according to an embodiment of the disclosure.

FIG. 12 is a flowchart of a self-diagnosis process among an operating method of a wireless vacuum cleaner according to an embodiment of the disclosure.

Referring to FIG. 12, in operation S1210, the processor 310 of the wireless vacuum cleaner 100 may obtain, as the third pressure value, a pressure value measured by the sensor 103 when the first suction motor 107 operates before the dust discharge operation is performed. Here, the dust discharge cover 109 is closed and there is no dust in the first dust collection part 106. Accordingly, the third pressure value may be defined as a pressure value of the first suction flow path 110-1 (in the case 2001 of FIG. 2) of the wireless vacuum cleaner 100 when the first suction motor 107 operates while there is no dust in the first dust collection part 106. The third pressure value may be referred to as the initial pressure value of the first suction flow path 110-1 (in the case 2001 of FIG. 2) of the wireless vacuum cleaner 100 when the first suction motor 107 operates.

In operation S1220, the processor 310 of the wireless vacuum cleaner 100 may obtain, as the fourth pressure value, a pressure value measured by the sensor 103 while dust is collected in the first dust collection part 106 when the first suction motor 107 operates before the dust discharge operation is performed. The fourth pressure value may be defined as a pressure value of the first suction flow path 110-1 (in the case 2001 of FIG. 2) of the wireless vacuum cleaner 100 while dust is collected in the first dust collection part 106 when the first suction motor 107 operates.

In operation S1230, the processor 310 of the wireless vacuum cleaner 100 may detect a difference between the third pressure value and the fourth pressure value. The processor 310 may detect the difference between the fourth pressure value and the third pressure value by subtracting the third pressure value from the fourth pressure value.

In operation S1240, the processor 310 of the wireless vacuum cleaner 100 may perform a self-diagnosis on the wireless vacuum cleaner 100, based on the difference. As described above with reference to FIG. 7, the self-diagnosis may be performed based on data (e.g., 751 Pa, 750 Pa to 401 Pa, and 400 Pa) pre-stored in the memory 320. The self-diagnosis performed on the wireless vacuum cleaner 100 by the processor 310 may include at least one of blocking of the first suction flow path 110-1 of the wireless vacuum cleaner 100, an inspection position (or a blocked location of the first suction flow path 110-1), a contaminated state of the first dust collection part 106 (or a state of the first dust collection part 106), or an operation of the wireless vacuum cleaner 100 being a normal state, but is not limited thereto.

In operation S1250, the processor 310 of the wireless vacuum cleaner 100 may output notification information regarding a self-diagnosis result. The processor 310 may output the notification information regarding the self-diagnosis result to the user interface 105. The processor 310 may transmit the notification information regarding the self-diagnosis result to the station device 200 or an external device, such as the user terminal 400 or the server device 500, through the communication interface 330. Accordingly, the user may take an action such that an issue occurred in the wireless vacuum cleaner 100 is resolved by resolving a suction flow path blocked state (or a blocked state of the first suction flow path 110-1) of the wireless vacuum cleaner 100 or inspecting the inspection position.

Figure 13:
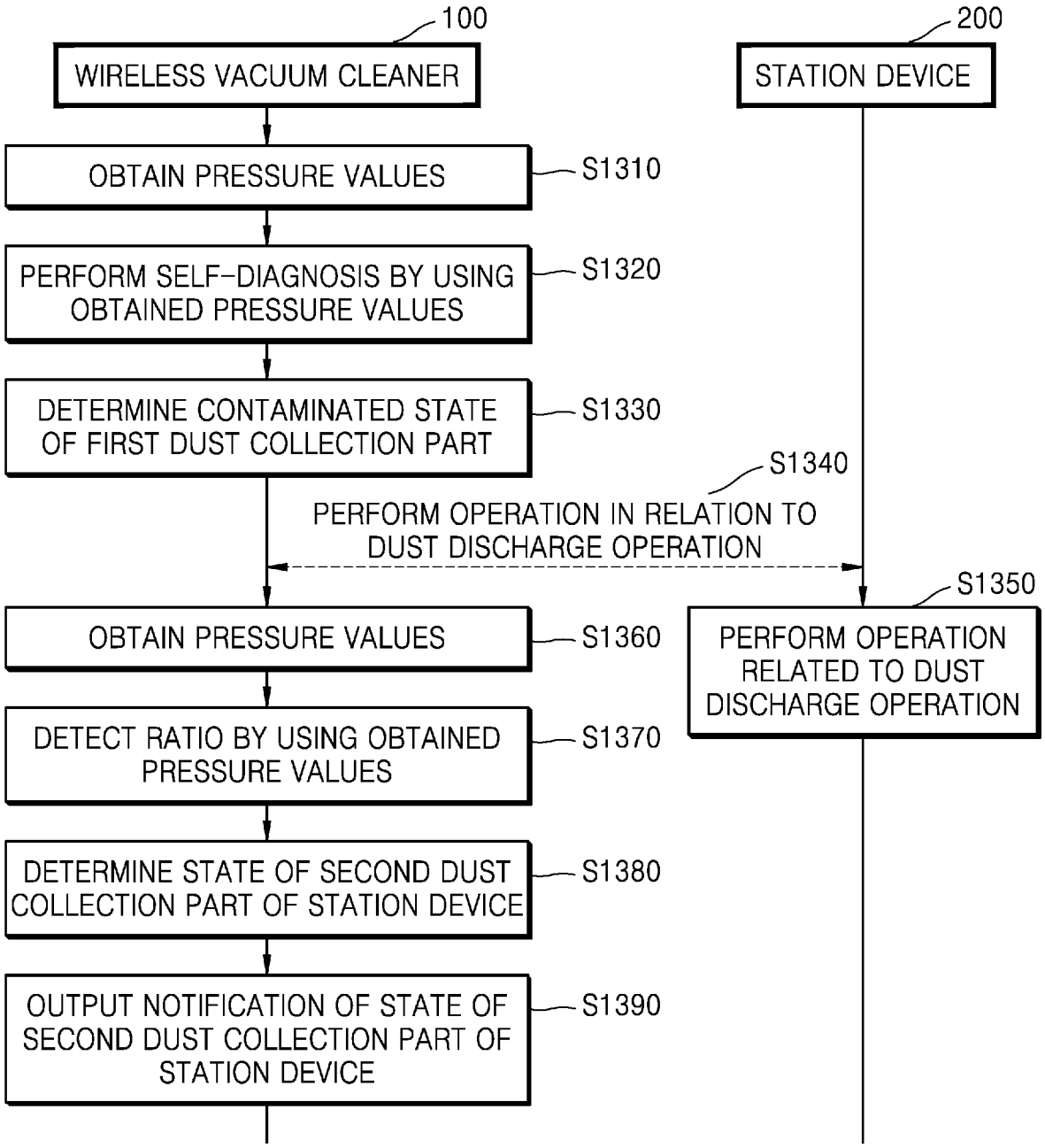
FIG. 13 is a flowchart of an operating method of a vacuum cleaner system including a wireless vacuum cleaner and a station device, according to an embodiment of the disclosure.

FIG. 13 is a flowchart of an operating method of a vacuum cleaner system including a wireless vacuum cleaner and a station device according to an embodiment of the disclosure.

Referring to FIG. 13, the wireless vacuum cleaner 100 performs the dust discharge operation when a contaminated state of the first dust collection part 106 is determined based on a pressure value measured by the sensor 103.

In operation S1310, the wireless vacuum cleaner 100 may obtain each of the third pressure value and the fourth pressure value measured by the sensor 103. The third pressure value may be defined as a pressure value of the first suction flow path 110-1 (in the case 2001 of FIG. 2) of the wireless vacuum cleaner 100 when the first suction motor 107 operates while there is no dust in the first dust collection part 106. The third pressure value may be referred to as the initial pressure value of the first suction flow path 110-1 (in the case 2001 of FIG. 2) of the wireless vacuum cleaner 100 when the first suction motor 107 operates. The fourth pressure value may be defined as a pressure value of the first suction flow path 110-1 (in the case 2001 of FIG. 2) of the wireless vacuum cleaner 100 while dust is collected in the first dust collection part 106 when the first suction motor 107 operates.

In operation S1320, the wireless vacuum cleaner 100 may perform the self-diagnosis on the wireless vacuum cleaner 100 by using the obtained third pressure value and fourth pressure value. The wireless vacuum cleaner 100 may perform the self-diagnosis on the wireless vacuum cleaner 100 by using the difference between the third pressure value and the fourth pressure value, as described above with reference to FIG. 7 and operation S1240 of FIG. 12.

The wireless vacuum cleaner 100 may determine a contaminated state of the first dust collection part 106 in operation S1330 and perform the dust discharge operation in operation S1340. When the processor 310 of the wireless vacuum cleaner 100 determines that the first dust collection part 106 needs to be cleaned in operation S1330, the dust discharge operation in which dust of the first dust collection part 106 is discharged to the second dust collection part 205 is performed in operation S1340 by operating the second suction motor 206 or operating an opening/closing device (not shown) that opens or closes the dust discharge cover 109 of the station device 200.

In operation S1350, the station device 200 may perform an operation related to the dust discharge operation. The operation related to the dust discharge operation of the station device 200, which is performed in operation S1350, may include an operation of opening the dust discharge cover 109, an operation of operating the second suction motor 206, or the like, but is not limited thereto. For example, the station device 200 may perform a notification operation of notifying the performing of the dust discharge operation. While the dust discharge operation is performed, the station device 200 may request the wireless vacuum cleaner 100 to perform an operation of determining a state of the second dust collection part 205 and perform an operation of receiving information about the state of the second dust collection part 205, determined by the wireless vacuum cleaner 100. Accordingly, the wireless vacuum cleaner 100 and the station device 200 may share the information about the state of the second dust collection part 205.

In operation S1360, the wireless vacuum cleaner 100 may obtain a pressure value measured by the sensor 103 while performing the dust discharge operation. In operation S1360, the wireless vacuum cleaner 100 obtains the first pressure value and the second pressure value. The first pressure value and the second pressure value may be referred to as pressure values of the second suction flow path 110-1, 110-2 formed between the wireless vacuum cleaner 100 and the station device 200. The first pressure value may be defined as a pressure value measured by the sensor 103 when there is no dust in the first dust collection part 106 and the second dust collection part 205, the dust discharge cover 109 is opened, and the second suction motor 206 operates. The second pressure value may be defined as a pressure value measured by the sensor 103 while dust of the first dust collection part 106 is discharged to the second dust collection part 205.

In operation S1370, the wireless vacuum cleaner 100 detects the ratio between the obtained first pressure value and second pressure value. The wireless vacuum cleaner 100 may detect the ratio between the first pressure value and the second pressure value according to (second pressure value/first pressure value)×100%.

In operation S1380, the wireless vacuum cleaner 100 may determine a state of the second dust collection part 205 according to the detected ratio. For example, as described above with reference to FIG. 4, the wireless vacuum cleaner 100 may determine the state of the second dust collection part 205 by using the first threshold value (e.g., 60%), the second threshold value (e.g., 40%) less than the first threshold value, and the third threshold value (e.g., 20%) less than the second threshold value.

In operation S1390, the wireless vacuum cleaner 100 may output a notification indicating the state of the second dust collection part 205 of the station device 200. In operation S1390, the wireless vacuum cleaner 100 may output notification information indicating the state of the second dust collection part 205 through the user interface 105. The wireless vacuum cleaner 100 may output the notification information indicating the state of the second dust collection part 205 to the station device 200 or an external device, such as the user terminal 400 or the server device 500, through the communication interface 330.

Figure 14:
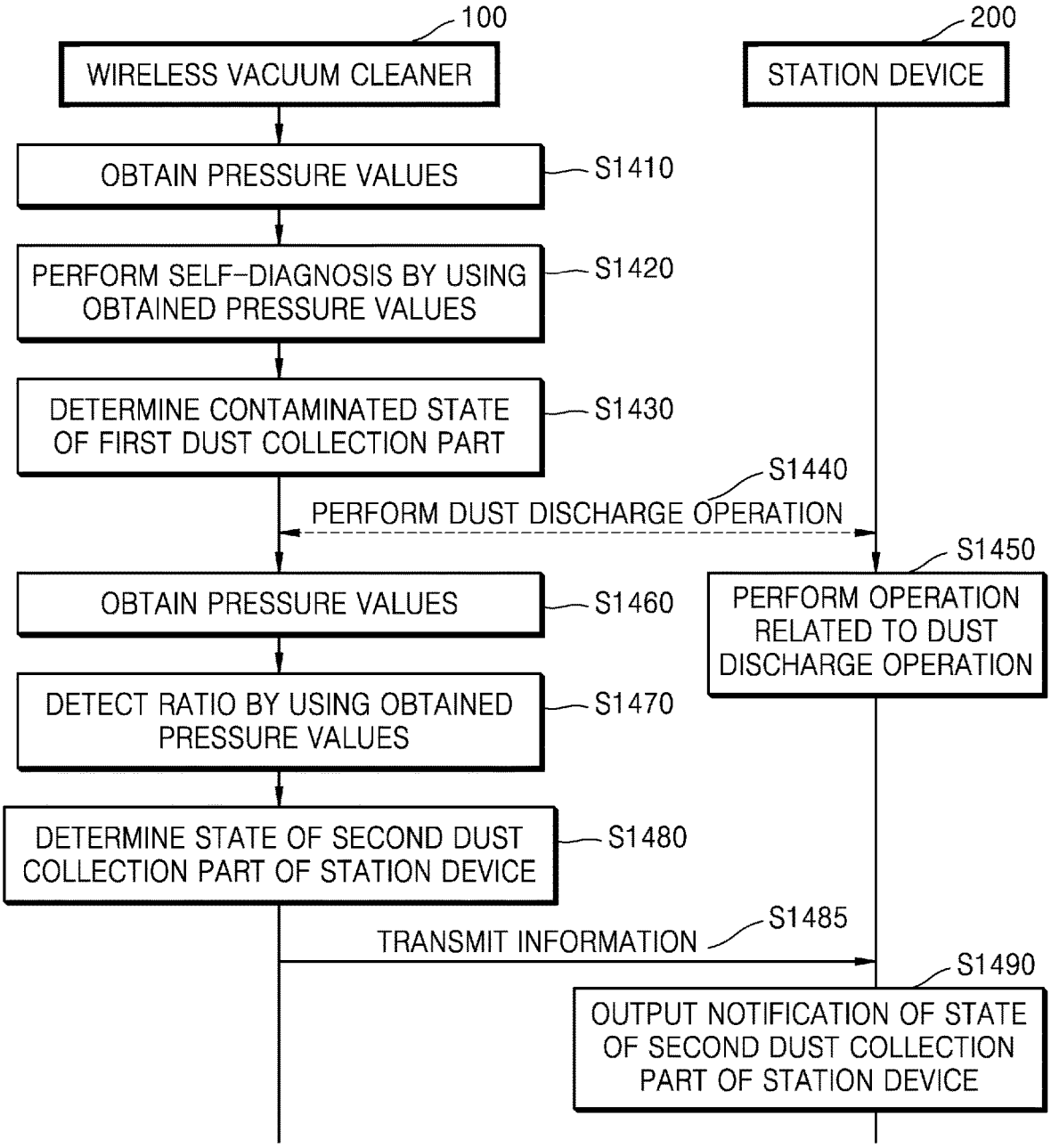
FIG. 14 is a flowchart of an operating method of a vacuum cleaner system including a wireless vacuum cleaner and a station device, according to an embodiment of the disclosure.

FIG. 14 is a flowchart of an operating method of a vacuum cleaner system including a wireless vacuum cleaner and a station device according to an embodiment of the disclosure.

Referring FIG. 14, the wireless vacuum cleaner 100 performs the dust discharge operation when a contaminated state of the first dust collection part 106 is determined based on a pressure value measured by the sensor 103.

In operation S1410, the wireless vacuum cleaner 100 may obtain each of the third pressure value and the fourth pressure value measured by the sensor 103. The third pressure value may be defined as a pressure value of the first suction flow path 110-1 (in the case 2001 of FIG. 2) of the wireless vacuum cleaner 100 when the first suction motor 107 operates while there is no dust in the first dust collection part 106. The third pressure value may be referred to as the initial pressure value of the first suction flow path 110-1 (in the case 2001 of FIG. 2) of the wireless vacuum cleaner 100 when the first suction motor 107 operates. The fourth pressure value may be defined as a pressure value of the first suction flow path 110-1 (in the case 2001 of FIG. 2) of the wireless vacuum cleaner 100 while dust is collected in the first dust collection part 106 when the first suction motor 107 operates.

In operation S1420, the wireless vacuum cleaner 100 may perform the self-diagnosis on the wireless vacuum cleaner 100 by using the obtained third pressure value and fourth pressure value. The wireless vacuum cleaner 100 may perform the self-diagnosis on the wireless vacuum cleaner 100 by using the difference between the third pressure value and the fourth pressure value, as described above with reference to FIG. 7 and operation S1240 of FIG. 12.

The wireless vacuum cleaner 100 may determine the contaminated state of the first dust collection part 106 in operation S1430 and perform the dust discharge operation in operation S1440. When the processor 310 of the wireless vacuum cleaner 100 determines that the first dust collection part 106 needs to be cleaned in operation S1430, the dust discharge operation in which dust of the first dust collection part 106 is discharged to the second dust collection part 205 is performed in operation S1440 by operating the second suction motor 206 or operating the opening/closing device (not shown) that opens or closes the dust discharge cover 109 of the station device 200.

In operation S1450, the station device 200 may perform the operation related to the dust discharge operation. The operation related to the dust discharge operation of the station device 200, which is performed in operation S1450, may include an operation of opening the dust discharge cover 109, an operation of operating the second suction motor 206, or the like, but is not limited thereto. For example, the station device 200 may perform a notification operation of notifying the performing of the dust discharge operation. While the dust discharge operation is performed, the station device 200 may request the wireless vacuum cleaner 100 to perform an operation of determining a state of the second dust collection part 205 and perform an operation of receiving information about the state of the second dust collection part 205, determined by the wireless vacuum cleaner 100. Accordingly, the wireless vacuum cleaner 100 and the station device 200 may share the information about the state of the second dust collection part 205.

In operation S1460, the wireless vacuum cleaner 100 may obtain a pressure value measured by the sensor 103 while performing the dust discharge operation. In operation S1460, the wireless vacuum cleaner 100 obtains the first pressure value and the second pressure value. The first pressure value and the second pressure value may be referred to as pressure values of the second suction flow path 110-1, 110-2 formed between the wireless vacuum cleaner 100 and the station device 200. The first pressure value may be defined as a pressure value measured by the sensor 103 when there is no dust in the first dust collection part 106 and the second dust collection part 205, the dust discharge cover 109 is opened, and the second suction motor 206 operates. The second pressure value may be defined as a pressure value measured by the sensor 103 while dust of the first dust collection part 106 is discharged to the second dust collection part 205.

In operation S1470, the wireless vacuum cleaner 100 detects the ratio between the obtained first pressure value and second pressure value. The wireless vacuum cleaner 100 may detect the ratio between the first pressure value and the second pressure value according to (second pressure value/first pressure value)×100%.

In operation S1480, the wireless vacuum cleaner 100 may determine a state of the second dust collection part 205 according to the detected ratio. For example, as described above with reference to FIG. 4, the wireless vacuum cleaner 100 may determine the state of the second dust collection part 205 by using the first threshold value (e.g., 60%), the second threshold value (e.g., 40%) less than the first threshold value, and the third threshold value (e.g., 20%) less than the second threshold value.

In operation S1485, the wireless vacuum cleaner 100 may transmit a notification indicating the state of the second dust collection part 205 of the station device 200 to the station device 200. In operation S1485, the wireless vacuum cleaner 100 may transmit notification information indicating the state of the second dust collection part 205 to the station device 200 through the communication interface 330.

In operation S1490, the station device 200 may output information about the state of the second dust collection part 205, received from the wireless vacuum cleaner 100, through the user interface 204. The station device 200 may transmit the information about the state of the second dust collection part 205 to an external device, such as the user terminal 400 or the server device 500, through the communication interface 201.

Figure 15:
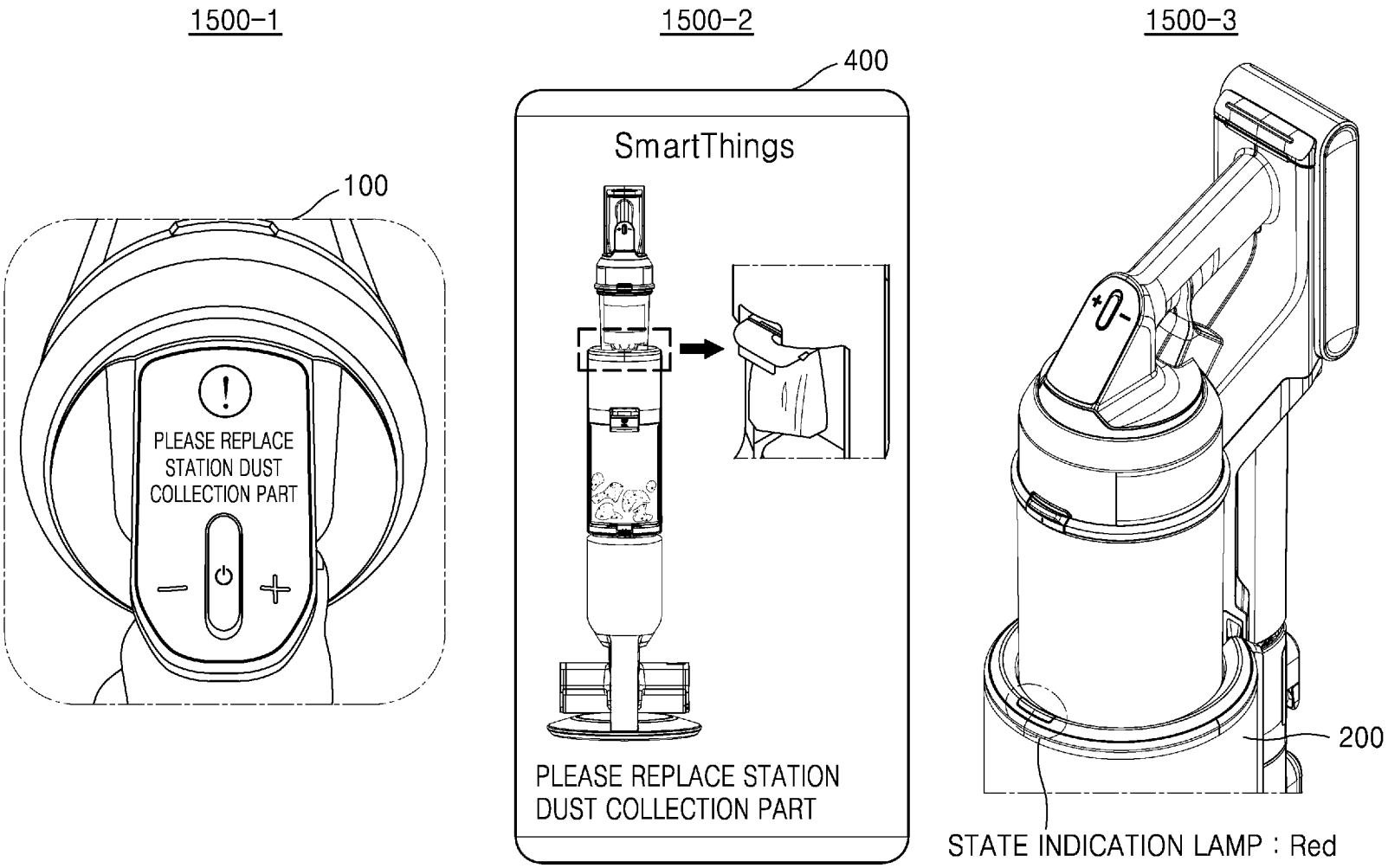
FIG. 15 is a diagram illustrating a state notification for a second dust collection part of a station device, according to an embodiment of the disclosure.

FIG. 15 is a diagram illustrating a state notification for a second dust collection part of a station device according to an embodiment of the disclosure.

Referring to 1500-1 of FIG. 15, the wireless vacuum cleaner 100 may output, through the user interface 105, information (e.g., please replace station dust collection part) that the second dust collection part 205 of the station device 200 is in a state in need of replacement.

Referring to 1500-2 of FIG. 15, the wireless vacuum cleaner 100 may transmit, to the server device 500 through long-range communication (e.g., Wi-F communication), information (e.g., please replace station dust collection part) that the second dust collection part 205 of the station device 200 is in a state in need of replacement. Here, the server device 500 may transmit information that the second dust collection part 205 of the station device 200 is in a state in need of check to the user terminal 400 registered under a same account as the station device 200. The user terminal 400 may output a notification to check a state of a dust bag on an application execution window, based on the information received from the server device 500.

Referring to 1500-3 of FIG. 15, the wireless vacuum cleaner 100 may control a state indication lamp (e.g., LED) to output a color (e.g., red) indicating that the second dust collection part 205 is in the state in need of replacement (or the replacement notification state), to the station device 200 through the communication interface 330. When the state indication lamp of the station device 200 changes to red, the user may realize that the second dust collection part 205 needs to be replaced. The wireless vacuum cleaner 100 may control the state indication lamp (e.g., LED) to output a color (e.g., yellow) indicating that the second dust collection part 205 is in the pre-replacement notification state, to the station device 200 through the communication interface 330. When the state indication lamp of the station device 200 is changed to yellow, the user may realize that a new second dust collection part 205 needs to be purchased to replace the second dust collection part 205 soon.

Figure 16:
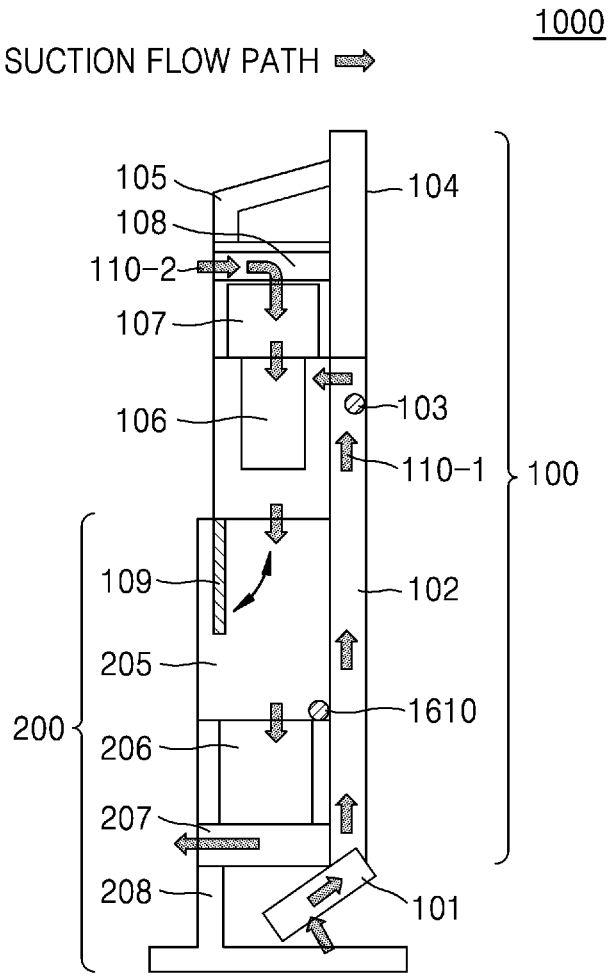
FIG. 16 is a diagram illustrating a vacuum cleaner system according to an embodiment of the disclosure.

FIG. 16 is a diagram illustrating a vacuum cleaner system according to an embodiment of the disclosure.

FIG. 16 illustrates a wireless vacuum cleaner includes a sensor as a first sensor and a station device includes a second sensor.

Referring to FIG. 16, the wireless vacuum cleaner 100 performs the self-diagnosis on the wireless vacuum cleaner 100, based on a pressure value measured by the sensor 103. Based on a result of performing the self-diagnosis, when an operating state of the wireless vacuum cleaner 100 is normal and the dust discharge operation of the wireless vacuum cleaner 100 needs to be performed, a pressure ratio may be detected by pressure values measured by the second sensor 1610 included in the station device 200, a state of the second dust collection part 205 may be determined according to the detected pressure ratio, and information about the determined state of the second dust collection part 205 may be output. The station device 200 may output the state of the second dust collection part 205 through the user interface 204 or transmit the state of the second dust collection part 205 to the wireless vacuum cleaner 100 or to an external device, such as the user terminal 400 or the server device 500.

FIG. 17 is a table of a relationship between a pressure value measured by a second sensor included in a station device, a pressure ratio, pre-set threshold values, and a state of a second dust collection part, when a dust discharge operation according to an embodiment of the disclosure is performed.

Referring to FIG. 17, the station device 200 obtains, as a fifth pressure value, a pressure value measured by the second sensor 1610, when the second suction motor 206 operates while there is no dust in the first dust collection part 106 and the second dust collection part 205. For example, the fifth pressure value is 880 mmH2O and may be defined as the initial pressure value of the second suction flow path 110-1, 110-2 between the wireless vacuum cleaner 100 and the station device 200.

The station device 200 may obtain, as a sixth pressure value, a pressure value measured by the second sensor 1610 when the dust discharge operation in which dust of the first dust collection part 106 is discharged to the second dust collection part 205 is performed. The sixth pressure value may be defined as a pressure value of the second suction flow path 110-1, 110-2 between the wireless vacuum cleaner 100 and the station device 200 when the dust discharge operation is performed.

For example, when the obtained sixth pressure value is 1080 mmH2O, the station device 200 detects a ratio between the fifth pressure value and the sixth pressure value. The station device 200 may detect the ratio between the fifth pressure value and the sixth pressure value according to (sixth pressure value/fifth pressure value)×100%. When the ratio between the fifth pressure value and the sixth pressure value is 123%, the detected ratio (123%) is less than a fourth threshold value (e.g., 160%), and thus, the station device 200 may determine a state of the second dust collection part 205 included in the station device 200 as a normal state.

For example, when the sixth pressure value measured by the second sensor 1610 is 1515 mmH2O, a ratio detected by the station device 200 is 172%, and thus is the fourth threshold value (160%) or more but is less than a fifth threshold value (210%), the fifth threshold value being more than the fourth threshold value. Accordingly, the station device 200 may determine a state of the second dust collection part 205 as a pre-replacement notification state.

For example, when the sixth pressure value measured by the second sensor 1610 is 1912 mmH2O, a ratio detected by the station device 200 is 217%. When the ratio is 217%, the ratio is the fifth threshold value (e.g., 210%) or more but is less than a sixth threshold value (e.g., 250%), the sixth threshold value being more than the fifth threshold value, the station device 200 may determine a state of the second dust collection part 205 as a replacement notification state.

For example, when the sixth pressure value measured by the second sensor 1610 is 2250 mmH2O, the station device 200 may detect the ratio between the fifth pressure value and the sixth pressure value as 256%. The detected ratio is the sixth threshold value (e.g., 250%) or more, and thus, the state of the second dust collection part 205 of the station device 200 may be determined as a state in which an operation of the second suction motor 206 needs to be stopped. Information about such determination standards based on the fourth threshold value (e.g., 160%), the fifth threshold value (e.g., 210%), and the sixth threshold value (e.g., 250%) may be stored in the memory 202 and read and used by the processor 203.

The station device 200 may transmit notification information about the determined state of the second dust collection part 205 to the wireless vacuum cleaner 100 or an external device, such as the user terminal 400 or the server device 500, through the communication interface 201. The station device 200 may transmit the notification information about the state of the second dust collection part 205 to the wireless vacuum cleaner 100, the user terminal 400, or the server device 500 through different communication schemes or a same communication scheme. Accordingly, the user may take an action in relation to the state of the second dust collection part 205.

The wireless vacuum cleaner 100 for discharging dust to the station device 200, according to an embodiment of the disclosure, may include the first dust collection part 106 configured to collect dust introduced to the wireless vacuum cleaner 100, the first suction motor 107 configured to generate suction power for collecting dust in the first dust collection part 106, the sensor 103 mounted on a portion of the first suction flow path (or a suction flow path) 110-1 of the wireless vacuum cleaner 100, and the at least one processor 310.

The at least one processor 310 according to an embodiment of the disclosure may be configured to obtain, as a first pressure value, a pressure value measured by the sensor 103 when the second suction motor 206 of the station device 200 operates while there is no dust in the first dust collection part 106 and the second dust collection part 205 of the station device 200, obtain, as a second pressure value, a pressure value measured by the sensor 103 when a dust discharge operation in which dust of the first dust collection part 106 is discharged to the second dust collection part 205 of the station device 200 is performed, detect a ratio of the second pressure value to the first pressure value, determine a state of the second dust collection part 205 according to the detected ratio, and output notification information indicating the determined state of the second dust collection part 205.

When the detected ratio according to an embodiment of the disclosure is less than a first threshold value but a second threshold value or more, the second threshold value being less than the first threshold value, the at least one processor 310 may be further configured to determine the state of the second dust collection part 205 to a pre-replacement notification state, and output the notification information indicating the pre-replacement notification state.

When the detected ratio according to an embodiment of the disclosure is less than the second threshold value but a third threshold value or more, the third threshold value being less than the second threshold value, the at least one processor 310 may be further configured to determine the state of the second dust collection part 205 to a replacement notification state, and output the notification information indicating the replacement notification state.

The at least one processor 310 according to an embodiment of the disclosure may be further configured to, when the detected ratio is less than the third threshold value, determine that an operation of the second suction motor 206 of the station device 200 is to be stopped, and output the notification information indicating an operation stop notification state of the second suction motor 206.

The at least one processor 310 according to an embodiment of the disclosure may be further configured to obtain the second pressure value in at least one duration from among a dust discharge operation duration when dust of the first dust collection part 106 is discharged to the second dust collection part 205 of the station device 200, a duration before the dust discharge operation is ended, and a stable duration of the dust discharge operation.

The at least one processor 310 according to an embodiment of the disclosure may be further configured to obtain, as a third pressure value, a pressure value measured by the sensor 103 when the first suction motor 107 operates while there is no dust in the first dust collection part 106, before the dust discharge operation is performed, obtain, as a fourth pressure value, a pressure value measured by the sensor 103 while dust is collected in the first dust collection part 106 when the first suction motor 107 operates, perform, based on a difference between the third pressure value and the fourth pressure value, a self-diagnosis on the wireless vacuum cleaner 100, including at least one of a suction flow path blocked state of the wireless vacuum cleaner 100, an inspection position of the wireless vacuum cleaner 100, a contaminated state of the first dust collection part 106, or a state in which an operation of the wireless vacuum cleaner 100 is normal, and output the notification information indicating a result of the self-diagnosis.

The at least one processor 310 according to an embodiment of the disclosure may be further configured to, when the first suction flow path 110-1 (or the suction flow path) of the wireless vacuum cleaner 100 is blocked, perform the dust discharge operation after an action on a blockage of the first suction flow path 110-1 of the wireless vacuum cleaner 100 is completed.

The wireless vacuum cleaner 100 according to an embodiment of the disclosure may further include the user interface 105 configured to output the notification information, wherein the at least one processor 310 may be further configured to output the notification information to the user interface 105.

The wireless vacuum cleaner 100 according to an embodiment of the disclosure may further include the communication interface 330 configured to communicate with the station device 200, wherein the at least one processor 310 may be further configured to transmit, to the station device 200 through the communication interface 330, at least one of the notification information, the first pressure value, the second pressure value, the detected ratio, the third pressure value, the fourth pressure value, or a difference between the third pressure value and the fourth pressure value.

The wireless vacuum cleaner 100 according to an embodiment of the disclosure may further include the communication interface 330 configured to communicate with the at least one external device 400, 500, wherein the at least one processor 310 may be further configured to transmit, to the at least one external device 400, 500 through the communication interface 330, at least one of the notification information, the first pressure value, the second pressure value, the detected ratio, the third pressure value, the fourth pressure value, or a difference between the third pressure value and the fourth pressure value.

The notification information according to an embodiment of the disclosure may include at least one of normal state information of the second dust collection part 205, pre-replacement notification state information of the second dust collection part 205, replacement notification state information of the second dust collection part 205, or operation stop notification state information of the second suction motor 206 of the station device 200.

An operating method of the wireless vacuum cleaner 100 including the sensor 103 mounted on a portion of the first suction flow path 110-1 of the wireless vacuum cleaner 100 for discharging dust to the station device 200, the first dust collection part 106 configured to collect dust introduced to the wireless vacuum cleaner 100, and the first suction motor 107 configured to generate suction power for collecting dust in the first dust collection part 106, according to an embodiment of the disclosure, may include obtaining, as a first pressure value, a pressure value measured by the sensor 103 when the second suction motor 206 of the station device 200 operates while there is no dust in the first dust collection part 106 and the second dust collection part 205 of the station device 200 (S910), obtaining, as a second pressure value, a pressure value measured by the sensor 103 when a dust discharge operation in which dust of the first dust collection part 106 is discharged to the second dust collection part 205 of the station device 200 is performed (S920), detecting a ratio of the second pressure value to the first pressure value (S930), detecting a state of the second dust collection part 205 included in the station device 200 according to the detected ratio (S940), and outputting notification information indicating the state of the second dust collection part 205 (S950).

When the detected ratio according to an embodiment of the disclosure is less than a first threshold value but a second threshold value or more, the second threshold value being less than the first threshold value (S1030), the determining of the state of the second dust collection part 205 may include determining a pre-replacement notification state of the second dust collection part 205 (S1040), and the outputting of the notification information may include outputting the notification information indicating the pre-replacement notification state of the second dust collection part 205 (S950).

When the detected ratio according to an embodiment of the disclosure is less than the second threshold value but a third threshold value or more, the third threshold value being less than the second threshold value (S1050), the determining of the state of the second dust collection part 205 may include determining a replacement notification state of the second dust collection part 205 (S1060), and the outputting of the notification information may include outputting the notification information indicating the replacement notification state of the second dust collection part 205 (S950).

The operating method according to an embodiment of the disclosure may further include, when the detected ratio is less than the third threshold value (S1070), determining an operation stop notification state of the second suction motor 206 included in the station device 200 (S1080).

The obtaining, as the second pressure value, of the pressure value measured by the sensor 103 (S920) according to an embodiment of the disclosure may include obtaining the second pressure value in at least one duration from among a dust discharge operation duration when dust of the first dust collection part 106 is discharged to the second dust collection part 205 of the station device 200, a duration before the dust discharge operation is ended, and a stable duration of the dust discharge operation.

The operating method according to an embodiment of the disclosure may further include obtaining, as a third pressure value, a pressure value measured by the sensor 103 when the first suction motor 107 operates while there is no dust in the first dust collection part 106, before the dust discharge operation is performed (S1210), obtaining, as a fourth pressure value, a pressure value measured by the sensor 103 while dust is collected in the first dust collection part 106 when the first suction motor 107 operates (S1220), performing, based on a difference between the third pressure value and the fourth pressure value, a self-diagnosis on the wireless vacuum cleaner 100, including at least one of a suction flow path blocked state of the wireless vacuum cleaner 100, an inspection position of the wireless vacuum cleaner 100, a contaminated state of the first dust collection part 106, or a state in which an operation of the wireless vacuum cleaner 100 is normal (S1230, S1240), and outputting a notification on a result of the self-diagnosis of the wireless vacuum cleaner 100 (S1250).

The operating method according to an embodiment of the disclosure may further include, when the first suction flow path 110-1 of the wireless vacuum cleaner 100 is blocked, performing the dust discharge operation after an action on a blockage of the first suction flow path 110-1 of the wireless vacuum cleaner 100 is completed (S1110).

The outputting of the notification information according to an embodiment of the disclosure may include outputting the notification information through a user interface 105 included in the wireless vacuum cleaner 100 (S950).

The outputting of the notification information according to an embodiment of the disclosure may include transmitting, to at least one of the station device 200 or the at least one external device 400, 500 through the communication interface 330 included in the wireless vacuum cleaner 100, at least one of the notification information, the first pressure value, the second pressure value, the detected ratio, the third pressure value, the fourth pressure value, or a difference between the third pressure value and the fourth pressure value.

In accordance with an aspect of the disclosure, one or more non-transitory computer-readable recording media is provided. The one or more non-transitory computer-readable recording media storing a program including instructions that, when executed by at least one processor of an electronic device, cause the electronic device to perform operations, the operations may include obtaining, as a first pressure value, a pressure value measured by a sensor when a second suction motor of a station device operates while there is no dust in a first dust collection part and a second dust collection part of the station device. The operations may include obtaining, as a second pressure value, a pressure value measured by the sensor when a dust discharge operation in which dust of the first dust collection part is discharged to the second dust collection part of the station device is performed. The operations may include detecting a ratio of the second pressure value to the first pressure value. The operations may include determining a state of the second dust collection part included in the station device according to the detected ratio. The operations may include outputting notification information indicating the state of the second dust collection part.

A machine-readable storage medium may be provided in the form of a non-transitory storage medium. Here, the "non-transitory storage medium" only denotes a tangible device and does not contain a signal (for example, electromagnetic waves). This term does not distinguish a case where data is stored in the storage medium semi-permanently and a case where the data is stored in the storage medium temporarily. For example, the "non-transitory storage medium" may include a buffer where data is temporarily stored.

According to an embodiment of the disclosure, a method according to an embodiment of the disclosure in the present specification may be provided by being included in a computer program product. The computer program products are products that can be traded between sellers and buyers. The computer program product may be distributed in the form of machine-readable storage medium (for example, compact disc read-only memory (CD-ROM)), or distributed (for example, downloaded or uploaded) through an application store or directly or online between two user devices (for example, smart phones). In the case of online distribution, at least a part of the computer program product (for example, a downloadable application) may be at least temporarily generated or temporarily stored in a machine-readable storage medium, such as a server of a manufacturer, a server of an application store, or memory of a relay server.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A wireless vacuum cleaner for discharging dust to a station device, the wireless vacuum cleaner comprising:

a first dust collection part configured to collect dust introduced to the wireless vacuum cleaner;

a first suction motor configured to generate suction power for collecting dust in the first dust collection part;

a sensor mounted on a portion of a first suction flow path of the wireless vacuum cleaner;

memory, comprising one or more storage media, storing instructions; and at least one processor communicatively coupled to the first suction motor, the sensor and the memory, wherein the instructions, when executed by the at least one processor individually or collectively, causes the wireless vacuum cleaner to:

obtain, as a first pressure value, a pressure value measured by the sensor when a second suction motor of the station device operates while there is no dust in the first dust collection part and a second dust collection part of the station device;

obtain, as a second pressure value, a pressure value measured by the sensor when a dust discharge operation in which dust of the first dust collection part is discharged to the second dust collection part of the station device is performed;

detect a ratio of the second pressure value to the first pressure value;

determine a state of the second dust collection part according to the detected ratio; and output notification information indicating the determined state of the second dust collection part.

2. The wireless vacuum cleaner of claim 1, wherein, when the detected ratio is less than a first threshold value but a second threshold value or more, the second threshold value being less than the first threshold value, the instructions that, when executed by the at least one processor individually or collectively, further cause the wireless vacuum cleaner to:

determine the state of the second dust collection part to a pre-replacement notification state; and output the notification information indicating the pre-replacement notification state.

3. The wireless vacuum cleaner of claim 2, wherein, when the detected ratio is less than the second threshold value but a third threshold value or more, the third threshold value being less than the second threshold value, the instructions that, when executed by the at least one processor individually or collectively, further cause the wireless vacuum cleaner to:

determine the state of the second dust collection part to a replacement notification state; and output the notification information indicating the replacement notification state.

4. The wireless vacuum cleaner of claim 3, wherein the instructions that, when executed by the at least one processor individually or collectively, further cause the wireless vacuum cleaner to:

when the detected ratio is less than the third threshold value, determine that an operation of the second suction motor of the station device is to be stopped, and output the notification information indicating an operation stop notification state of the second suction motor.

5. The wireless vacuum cleaner of claim 1, wherein the instructions that, when executed by the at least one processor individually or collectively, further cause the wireless vacuum cleaner to obtain the second pressure value in at least one duration from among a dust discharge operation duration when dust of the first dust collection part is discharged to the second dust collection part of the station device, a duration before the dust discharge operation is ended, and a stable duration of the dust discharge operation.

6. The wireless vacuum cleaner of claim 1, wherein the instructions that, when executed by the at least one processor individually or collectively, further cause the wireless vacuum cleaner to:

obtain, as a third pressure value, a pressure value measured by the sensor when the first suction motor operates while there is no dust in the first dust collection part, before the dust discharge operation is performed, obtain, as a fourth pressure value, a pressure value measured by the sensor while dust is collected in the first dust collection part when the first suction motor operates, perform, based on a difference between the third pressure value and the fourth pressure value, a self-diagnosis on the wireless vacuum cleaner, including at least one of a suction flow path blocked state of the wireless vacuum cleaner, an inspection position of the wireless vacuum cleaner, a contaminated state of the first dust collection part, or a state in which an operation of the wireless vacuum cleaner is normal, and output the notification information indicating a result of the self-diagnosis.

7. The wireless vacuum cleaner of claim 6, wherein the instructions that, when executed by the at least one processor individually or collectively, further cause the wireless vacuum cleaner to, when the first suction flow path of the wireless vacuum cleaner is blocked, perform the dust discharge operation after an action on a blockage of the suction flow path of the wireless vacuum cleaner is completed.

8. The wireless vacuum cleaner of claim 6, wherein the wireless vacuum cleaner further comprises a communication interface configured to communicate with the station device, and wherein the instructions that, when executed by the at least one processor individually or collectively, further cause the wireless vacuum cleaner to transmit, to the station device through the communication interface, at least one of the notification information, the first pressure value, the second pressure value, the detected ratio, the third pressure value, the fourth pressure value, or a difference between the third pressure value and the fourth pressure value.

9. The wireless vacuum cleaner of claim 8, wherein the wireless vacuum cleaner further comprises the communication interface configured to communicate with at least one external device, and wherein the instructions that, when executed by the at least one processor individually or collectively, further cause the wireless vacuum cleaner to transmit, to the at least one external device through the communication interface, at least one of the notification information, the first pressure value, the second pressure value, the detected ratio, the third pressure value, the fourth pressure value, or a difference between the third pressure value and the fourth pressure value.

10. The wireless vacuum cleaner of claim 1, wherein the wireless vacuum cleaner further comprises a user interface configured to output the notification information, and wherein the instructions that, when executed by the at least one processor individually or collectively, further cause the wireless vacuum cleaner to output the notification information to the user interface.

11. The wireless vacuum cleaner of claim 1, wherein the notification information comprises at least one of normal state information of the second dust collection part, pre-replacement notification state information of the second dust collection part, replacement notification state information of the second dust collection part, or operation stop notification state information of the second suction motor of the station device.

12. A method of operating a wireless vacuum cleaner, the wireless vacuum cleaner comprising:

a sensor mounted on a portion of a first suction flow path of the wireless vacuum cleaner for discharging dust to a station device;

a first dust collection part configured to collect dust introduced to the wireless vacuum cleaner; and a first suction motor configured to generate suction power for collecting dust in the first dust collection part, the method comprising:

obtaining, as a first pressure value, a pressure value measured by the sensor when a second suction motor of the station device operates while there is no dust in the first dust collection part and a second dust collection part of the station device;

obtaining, as a second pressure value, a pressure value measured by the sensor when a dust discharge operation in which dust of the first dust collection part is discharged to the second dust collection part of the station device is performed;

detecting a ratio of the second pressure value to the first pressure value;

detecting a state of the second dust collection part included in the station device according to the detected ratio; and outputting notification information indicating the state of the second dust collection part.

13. The method of claim 12, wherein, when the detected ratio is less than a first threshold value but a second threshold value or more, the second threshold value being less than the first threshold value, wherein the detecting of the state of the second dust collection part comprises determining a pre-replacement notification state of the second dust collection part; and wherein the outputting of the notification information comprises outputting the notification information indicating the pre-replacement notification state of the second dust collection part.

14. The method of claim 13, wherein, when the detected ratio is less than the second threshold value but a third threshold value or more, the third threshold value being less than the second threshold value, wherein the detecting of the state of the second dust collection part comprises determining a replacement notification state of the second dust collection part; and wherein the outputting of the notification information comprises outputting the notification information indicating the replacement notification state of the second dust collection part.

15. The method of claim 14, further comprising, when the detected ratio is less than the third threshold value, determining an operation stop notification state of the second suction motor included in the station device.

16. The method of claim 12, wherein the obtaining, as the second pressure value, of the pressure value measured by the sensor comprises obtaining the second pressure value in at least one duration from among a dust discharge operation duration when dust of the first dust collection part is discharged to the second dust collection part of the station device, a duration before the dust discharge operation is ended, and a stable duration of the dust discharge operation.

17. The method of claim 12, further comprising:

obtaining, as a third pressure value, a pressure value measured by the sensor when the first suction motor operates while there is no dust in the first dust collection part, before the dust discharge operation is performed;

obtaining, as a fourth pressure value, a pressure value measured by the sensor while dust is collected in the first dust collection part when the first suction motor operates;

performing, based on a difference between the third pressure value and the fourth pressure value, a self-diagnosis on the wireless vacuum cleaner, including at least one of a suction flow path blocked state of the wireless vacuum cleaner, an inspection position of the wireless vacuum cleaner, a contaminated state of the first dust collection part, or a state in which an operation of the wireless vacuum cleaner is normal; and outputting a notification on a result of the self-diagnosis of the wireless vacuum cleaner.

18. The method of claim 17, further comprising, when the first suction flow path of the wireless vacuum cleaner is blocked, performing the dust discharge operation after an action on a blockage of the first suction flow path of the wireless vacuum cleaner is completed.

19. The method of claim 17, wherein the outputting of the notification information comprises transmitting, to at least one of the station device or at least one external device through a communication interface included in the wireless vacuum cleaner, at least one of the notification information, the first pressure value, the second pressure value, the detected ratio, the third pressure value, the fourth pressure value, or a difference between the third pressure value and the fourth pressure value.

20. The method of claim 12, wherein the outputting of the notification information comprises outputting the notification information through a user interface included in the wireless vacuum cleaner.

* * * * *